US009646596B2

(12) United States Patent
Tani et al.

(10) Patent No.: US 9,646,596 B2
(45) Date of Patent: May 9, 2017

(54) ACTIVE NOISE REDUCTION DEVICE, INSTRUMENT USING SAME, AND ACTIVE NOISE REDUCTION METHOD

(71) Applicant: Panasonic Intellectual Property Management Co., Ltd., Osaka (JP)

(72) Inventors: Mitsuhiro Tani, Osaka (JP); Mitsuru Kaitou, Osaka (JP); Toshiyuki Funayama, Osaka (JP)

(73) Assignee: PANASONIC INTELLECTUAL PROPERTY MANAGEMENT CO., LTD., Osaka (JP)

( * ) Notice: Subject to any disclaimer, the term of this patent is extended or adjusted under 35 U.S.C. 154(b) by 0 days.

(21) Appl. No.: 14/762,482

(22) PCT Filed: Jan. 21, 2014

(86) PCT No.: PCT/JP2014/000269

§ 371 (c)(1),
(2) Date: Jul. 22, 2015

(87) PCT Pub. No.: WO2014/115533

PCT Pub. Date: Jul. 31, 2014

(65) Prior Publication Data

US 2015/0356965 A1 Dec. 10, 2015

(30) Foreign Application Priority Data

Jan. 28, 2013 (JP) ..... 2013-012832

(51) Int. Cl.

| | |
|---|---|
| ***G10K 11/16*** | (2006.01) |
| ***G10K 11/175*** | (2006.01) |
| ***G10K 11/178*** | (2006.01) |

(52) U.S. Cl.
CPC ..... *G10K 11/175* (2013.01); *G10K 11/178* (2013.01); *G10K 2210/1282* (2013.01);
(Continued)

(58) Field of Classification Search
CPC ..... G10K 11/178; G10K 2210/108; G10K 2210/3018; G10K 2210/3054;
(Continued)

(56) References Cited

U.S. PATENT DOCUMENTS 5,608,804 A * 3/1997 Hirano ..... H03H 21/0012 379/406.08
5,758,311 A 5/1998 Tsuji et al.
(Continued)

FOREIGN PATENT DOCUMENTS

JP 5-216484 8/1993
JP 7-028474 1/1995
(Continued)

OTHER PUBLICATIONS

International Search Report of PCT application No. PCT/JP2014/000269 dated Apr. 22, 2014.
(Continued)

*Primary Examiner* — Akelaw Teshale
(74) *Attorney, Agent, or Firm* — McDermott Will & Emery LLP

(57) ABSTRACT

In an active noise reduction device, in order to solve this problem, a control block determines a level of a reference signal detected by a level detection unit. If determining that the level of the reference signal is small, the control block decreases a level of a cancel signal. This operation suppresses generation of an abnormal sound even if a level of a noise is small.

39 Claims, 19 Drawing Sheets

(52) U.S. Cl.
CPC ..... *G10K 2210/3016* (2013.01); *G10K 2210/3039* (2013.01)

(58) Field of Classification Search
CPC ..... H03H 2021/0078; H03H 21/0012; H04L 2025/0349; H04L 25/03057; H04L 2025/03611; H04L 2025/03687; H04L 25/0224; H04L 25/025; H04M 9/082; H04R 3/02; H04R 2460/01
USPC ..... 381/71.11, 71.4, 71.8, 71.1, 94.7, 122, 381/71.12, 71.2, 71.5, 86, 94.1
See application file for complete search history.

(56) References Cited

U.S. PATENT DOCUMENTS

| | | | | |
|---|---|---|---|---|
| 6,418,227 | B1 * | 7/2002 | Kuo | G10K 11/1788 381/71.1 |
| 7,103,188 | B1 | 9/2006 | Jones | |
| 7,792,312 | B2 * | 9/2010 | Inoue | G10K 11/1782 381/71.14 |
| 8,014,538 | B2 * | 9/2011 | Onishi | G10K 11/1784 381/71.14 |
| 2007/0172004 | A1 * | 7/2007 | Funayama | G10K 11/178 375/346 |
| 2010/0061564 | A1 | 3/2010 | Clemow et al. | |
| 2012/0140943 | A1 | 6/2012 | Hendrix et al. | |
| 2012/0316872 | A1 | 12/2012 | Stoltz et al. | |

FOREIGN PATENT DOCUMENTS

| | | |
|---|---|---|
| JP | 7-261774 | 10/1995 |
| JP | 2000-267674 | 9/2000 |
| JP | 2003-027916 | 1/2003 |
| JP | 2012-123135 | 6/2012 |

OTHER PUBLICATIONS

The Extended European Search Report dated May 20, 2016 for the related European Patent Application No. 14743643.0.

* cited by examiner

ACTIVE NOISE REDUCTION DEVICE, INSTRUMENT USING SAME, AND ACTIVE NOISE REDUCTION METHOD

This application is a U.S. national stage application of the PCT international application No. PCT/JP2014/000269 filed on Jan. 21, 2014, which claims the benefit of foreign priority of Japanese patent application No. 2013-012832 filed on Jan. 28, 2013, the contents all of which are incorporated herein by reference.

TECHNICAL FIELD

The present invention relates to an active noise reduction device for reducing a noise by causing a cancel sound to interfere with the noise, an apparatus using the active noise reduction device, and an active noise reduction method.

BACKGROUND ART

In recent years, active noise reduction devices have been put in practical use. Such an active noise reduction device cancels a noise that is generated during an operation (drive) of an apparatus, such as an automobile, in a passenger compartment, and reduces the noise audible to a driver and a passenger. FIG. 22 is a block diagram of conventional active noise reduction system 901 for reducing noise N0 that is audible in space S1, such as a passenger compartment of an automobile. Conventional active noise reduction system 901 includes reference signal source 1, cancel sound source 2, error signal source 3, and active noise reduction device 904.

Reference signal source 1 outputs a reference signal x(i) that has a correlation with noise N0. Active noise reduction device 904 has the reference signal x(i) input thereto, and outputs a cancel signal y(i). Cancel sound source 2 outputs cancel sound N1 corresponding to the cancel signal y(i) into space S1, such as the passenger compartment. Error signal source 3 outputs an error signal e(i) corresponding to a residual sound caused by interference between noise N0 and cancel sound N1 in space S1.

Active noise reduction device 904 includes adaptive filter (hereinafter, ADF) 905, simulated acoustic transfer characteristic data filter (hereinafter, Chat) 6, and least mean square operation unit (hereinafter, LMS operation unit) 907. Active noise reduction device 904 operates at discrete time intervals of a sampling period $T_s$.

ADF 905 includes a finite impulse response (hereinafter, FIR) type adaptive filter composed of N filter coefficients w(k) with values updated every sampling period $T_s$ (where k=0, 1, . . . , N−1). The current filter coefficient w(k,n) is updated by a filtered X-LMS (hereinafter, FxLMS) algorithm. ADF 905 outputs the current cancel signal y(n) by using the filter coefficient w(k,n) and the reference signal x(i). In other words, ADF 905 determines the cancel signal y(n) by performing a filtering operation, that is, a convolution operation expressed by Formula 1. In this description, the current time is an n-th step. Accordingly, a next time (or a next point in time) is a (n+1)-th step, and a last time is a (n−1)-th step.

$$y(n) = \sum_{k=0}^{N-1} w(k, n) \cdot x(n-k) \quad \text{(Formula 1)}$$

Chat 6 has an FIR type filter composed of a time-invariant filter coefficient (hereinafter, simulated acoustic transfer characteristic data) Cˆ that simulates an acoustic transfer characteristic C(i) of a signal transfer path of the cancel signal y(i). The signal transfer path mentioned here refers to a transfer path from output of the cancel signal y(i) to arrival of the error signal e(i) at LMS operation unit 907. Chat 6 outputs a filtered reference signal r(i) obtained by performing a filtering operation on the simulated acoustic transfer characteristic data Cˆ and the reference signal x(i).

LMS operation unit 907 updates a current filter coefficient W(n) of ADF 905 by using a current filtered reference signal R(n), the error signal e(n), and a step size parameter μ. LMS operation unit 907 then calculates the next-step filter coefficient W(n+1), as expressed by Formula 2.

$$W(n+1)=W(n)-\mu \cdot e(n) \cdot R(n) \quad \text{(Formula 2)}$$

Here, the filter coefficient W(n) of ADF 905 is a vector with N rows and one column, as expressed by Formula 3, and is composed of N current filter coefficients w(k,n).

$$W(n)=[w(0,n), w(1,n), \ldots, w(N-1,n)]^T \quad \text{(Formula 3)}$$

The filtered reference signal R(n) is also a vector with N rows and one column, and is composed of N filtered reference signals r(i) from the current time to the past by (N−1) steps.

Active noise reduction system 901 updates the filter coefficient W(i) of ADF 905 every sampling period $T_s$, as expressed by Formula 2. As a result, active noise reduction system 901 outputs the cancel signal y(i) for canceling noise N0 at a position of error signal source 3.

A conventional active noise reduction system similar to active noise reduction system 901 is described in PTL 1.

In conventional active noise reduction device 904, if a level of noise N0 decreases, cancel sound N1 that is output from cancel sound source 2 may become larger than noise N0, and thus cancel sound N1 may become an abnormal sound.

CITATION LIST

Patent Literature

PTL 1: Japanese Patent Laid-Open Publication No. 07-28474

SUMMARY

An active noise reduction device includes a cancel signal generation block, a simulated acoustic transfer characteristic data filter, a least mean square operation unit, a level detection unit, and a control block. The level detection unit has a reference signal input thereto, detects a level of the reference signal, and outputs the detected signal level of the reference signal to the control block. The control block has the signal level of the reference signal input thereto, and determines the signal level. If determining that the level of the reference signal is small, the control block decreases the level of the cancel signal.

This active noise reduction device can suppress generation of the abnormal sound and reduce the noise well.

DETAIL DESCRIPTION OF PREFERRED EMBODIMENTS

Exemplary Embodiment 1

Figure 1:
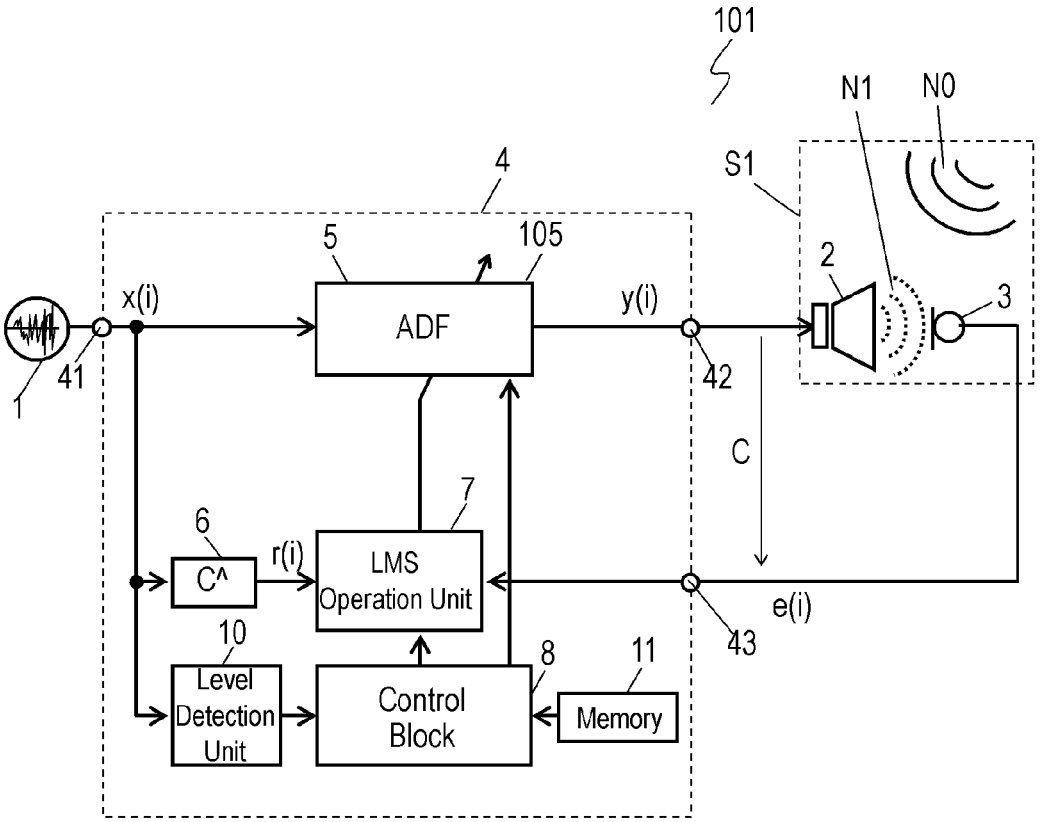
FIG. 1 is a block diagram of an active noise reduction system using an active noise reduction device of a first example according to Exemplary Embodiment 1 of the present invention.

FIG. 1 is a block diagram of active noise reduction system 101 using active noise reduction device 4 of a first example according to Exemplary Embodiment 1 of the present invention.

Active noise reduction system 101 according to the present embodiment includes reference signal source 1, cancel sound source 2, error signal source 3, and active noise reduction device 4. Active noise reduction device 4 includes reference signal input terminal 41, output terminal 42, error signal input terminal 43, cancel signal generation block 105, simulated acoustic transfer characteristic data filter (hereinafter, Chat) 6, least mean square (LMS) operation unit 7, control block 8, level detection unit 10, and storage unit 11.

Reference signal source 1 outputs a reference signal x(i) that has a correlation with noise N0. Active noise reduction device 4 has the reference signal x(i) input thereto, and outputs a cancel signal y(i). Cancel sound source 2 outputs cancel sound N1 corresponding to the cancel signal y(i) into space S1, such as a passenger compartment. Error signal source 3 outputs an error signal e(i) corresponding to a residual sound caused by interference between noise N0 and cancel sound N1 in space S1.

Reference signal input terminal 41 has the reference signal x(i) input thereto. The reference signal x(i) is output from reference signal source 1. The reference signal x(i) having a correlation with noise N0.

Cancel signal generation block 105 includes adaptive filter (hereinafter, ADF) 5, and outputs the cancel signal y(i) that is based on the reference signal x(i).

Output terminal 42 then outputs the cancel signal y(i) that is output from cancel signal generation block 105 to cancel sound source 2. The cancel signal y(i) that is output from output terminal 42 is converted, by cancel sound source 2, into cancel sound N1 corresponding to the cancel signal y(i), and is emitted into space S1. Error signal input terminal 43 has the error signal e(i) input thereto, The error signal e(i) is the residual sound caused by interference between noise N0 and cancel sound N1 that is output from cancel sound source 2.

Chat 6 corrects the reference signal x(i) with simulated acoustic transfer characteristic data CA, and outputs a filtered reference signal r(i) to LMS operation unit 7. Here, the simulated acoustic transfer characteristic data $\hat{C}$ refers to data that simulates an acoustic transfer characteristic C of a signal transfer path from output of the cancel signal y(i) from cancel signal generation block 105 to arrival of the error signal e(i) at LMS operation unit 7.

LMS operation unit 7 updates a filter coefficient W(i) to be used by ADF 5 by using the current error signal e(i), a filtered reference signal R(i), and a step size parameter μ.

Level detection unit 10 detects a signal level $L_x(i)$ of the reference signal x(i), and outputs the signal level $L_x(i)$ to control block 8. Control block 8 determines the signal level $L_x(i)$ detected by level detection unit 10. If control block 8 determines that the signal level $L_x(i)$ is small, control block 8 makes an adjustment to decrease a level (amplitude) of the cancel signal y(i). As a result of the adjustment, the cancel signal y(i) is adjusted in a direction in which the level (amplitude) decreases.

Control block 8 may be configured so that control block 8 directly adjusts the cancel signal y(i). Alternatively, control block 8 may adjust the cancel signal y(i) indirectly via another block or the like.

Here, the reference signal x(i) contains a noise component signal $x_N(i)$, which is a signal resulting from noise N0, and a reference signal noise $x_z(i)$, which is a noise component. The reference signal noise $x_z(i)$ contains noises, such as a noise generated by reference signal source 1 itself, and a noise generated in a process in which the reference signal x(i) that is output from reference signal source 1 is acquired by reference signal input terminal 41.

The noise component signal $x_N(i)$ has a high correlation with noise N0. However, the reference signal noise $x_z(i)$ has no correlation with noise N0. If noise N0 is small and a level of the noise component signal $x_N(i)$ resulting from noise N0 is small, the signal level $L_N(i)$ of the noise component signal $x_N(i)$ may become smaller than a signal level $L_z(i)$ of the reference signal noise $x_z(i)$ at least at some frequencies of the reference signal x(i). In this case, cancel sound N1 that contains a noise sound corresponding to the reference signal noise $x_z(i)$ is output from cancel sound source 2. Accordingly, the noise sound resulting from the reference signal noise $x_z(i)$ causes an abnormal sound.

With the aforementioned configuration, control block 8 decreases the level of the cancel signal y(i) that is output from cancel signal generation block 105 if control block 8 determines that the signal level $L_x(i)$ of the reference signal x(i) is small. As a result, the sound of cancel sound N1 corresponding to the reference signal noise $x_z(i)$ that is output from cancel sound source 2 can be decreased. Therefore, it is possible to provide active noise reduction device 4 capable of controlling generation of the abnormal sound caused by the reference signal noise $x_z(i)$, and capable of reducing noise N0 well, even if noise N0 is small.

Figure 2:
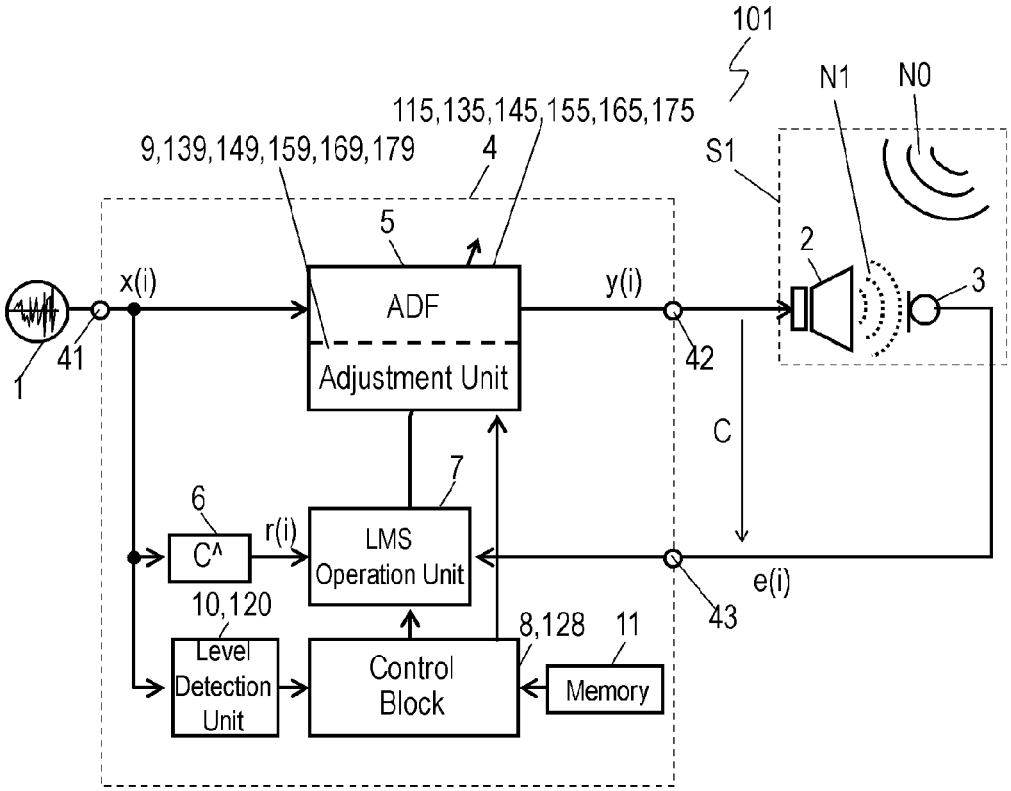
FIG. 2 is a block diagram of the active noise reduction system using the active noise reduction device of second to eighth examples according to Embodiment 1.
Figure 3:
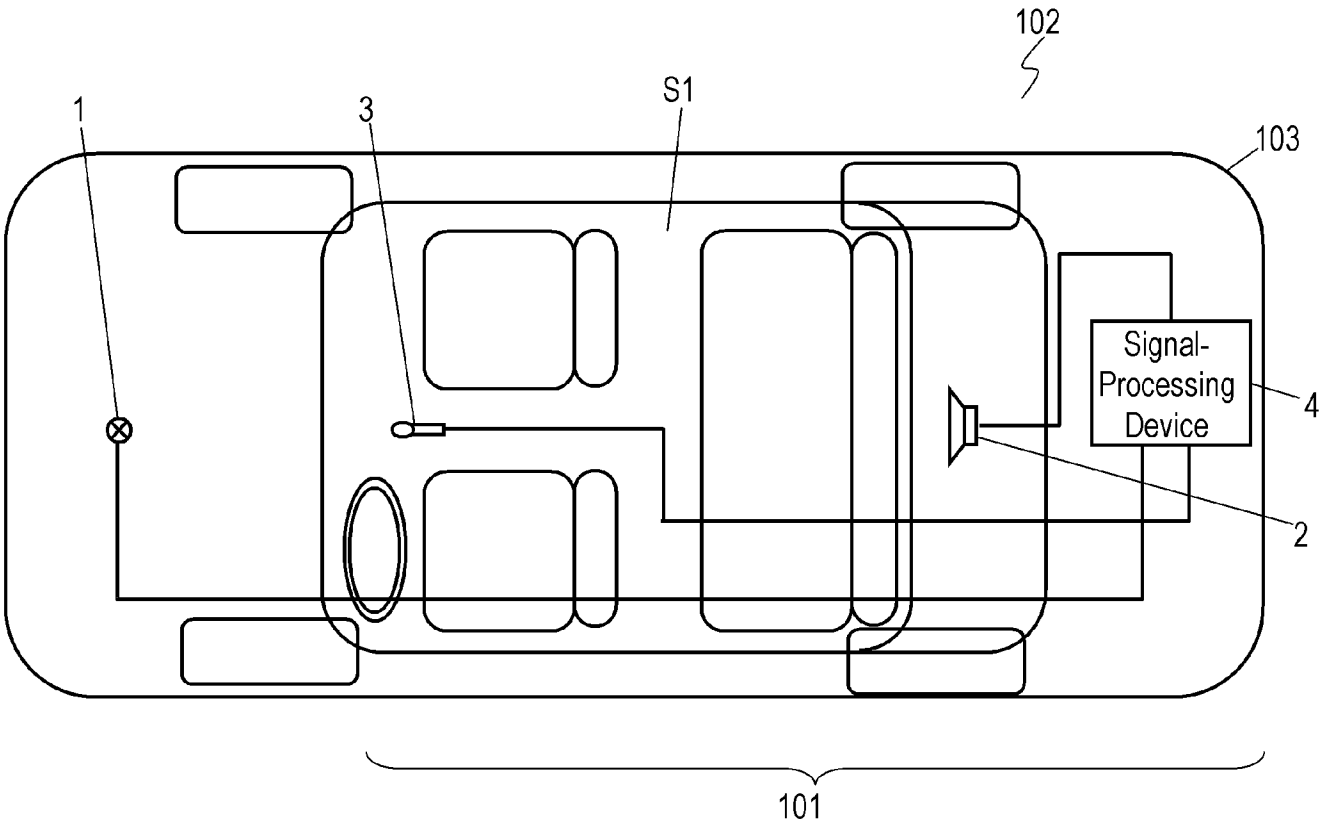
FIG. 3 is a schematic diagram of a mobile unit apparatus using the active noise reduction device according to Embodiment 1.

Next, a configuration of active noise reduction device 4 according to the present exemplary embodiment will be described in detail. FIG. 2 is a block diagram of active noise reduction system 101 using active noise reduction device 4 of a second example according to Embodiment 1. FIG. 3 is a schematic diagram of a mobile unit apparatus using active noise reduction device 4 according to Embodiment 1. In FIG. 2 and FIG. 3, components identical to components of FIG. 1 are denoted by the same reference numerals.

Active noise reduction device 4 according to the present exemplary embodiment is mounted and used in the apparatus. The apparatus includes an apparatus body, space S1, and active noise reduction system 101. Active noise reduction system 101 includes reference signal source 1, cancel sound source 2, error signal source 3, and active noise reduction device 4. Space S1 is a room or the like provided in the apparatus body, and a person enters this room.

In the following description, automobile 102 is discussed as an example of the apparatus. Space S1 in this example is a passenger compartment provided in body 103 (apparatus body) of automobile 102, the passenger compartment being boarded by a person. The person who boards the passenger compartment includes a driver and a passenger. Here, the driver is used as an example of an operator who operates the apparatus. The passenger is used as an example of a user who uses the apparatus. The operator and the user may be one person.

In FIG. 2 and FIG. 3, reference signal source 1 is a transducer and is connected to reference signal input terminal 41 of active noise reduction device 4. Reference signal source 1 is fixed to a chassis of automobile 102 or the like in order to output the reference signal x(i) that has a correlation with noise N0. Alternatively, reference signal source 1 may be installed in a noise source or noise transfer path of noise N0. For example, reference signal source 1 may be installed in an engine, an axle, a body, a tire, a tire house, a knuckle, an arm, a sub frame, an exterior, an interior, and the like. As reference signal source 1, an acceleration sensor, a microphone, and the like that detect vibration or sound can be used. Reference signal source 1 may detect a signal related to an operation of the noise source, such as tacho-pulses with respect to the engine.

Cancel sound source 2 is a transducer and generates cancel sound N1 corresponding to the cancel signal y(i). For example, a speaker can be used as cancel sound source 2. Cancel sound source 2 is installed within body 103 so as to emit cancel sound N1 into space S1. A speaker, amplifier, or the like of a car audio system may be used as cancel sound source 2. In this case, it is not necessary to use dedicated cancel sound source 2 separately. In addition, an actuator or the like can also be used as cancel sound source 2. In this case, cancel sound source 2 is installed, for example, in a structure, such as a roof, of automobile 102. If an output of the actuator excites the structure, the structure emits cancel sound N1.

In addition, cancel sound source 2 typically includes a power amplification unit for amplifying the cancel signal y(i). Cancel sound source 2 may be driven by the cancel signal y(i) amplified by an externally provided power amplifier. Although the power amplification unit according to Embodiment 1 is included in cancel sound source 2, this does not limit the exemplary embodiment. Furthermore, cancel sound source 2 may also include a filter, such as a low pass filter, and a signal conditioner for adjusting signal amplitude and phase of the cancel signal y(i). At least one of these sections may be provided on a cancel signal generation block 115 side.

Error signal source 3 detects the residual sound, which is a residual sound in space S1, caused by interference between noise N0 and cancel sound N1, and outputs the error signal e(i) corresponding to the residual sound. Error signal source 3 is a transducer, and a microphone or the like can be used. Error signal source 3 is installed in body 103 so that the residual sound in space S1 can be collected. Therefore, error signal source 3 is preferably installed within space S1 in which noise N0 is to be reduced. For example, error signal source 3 is installed at a position, such as a headrest or an overhead, of a seat on which the passenger sits. That is, installation of error signal source 3 at a position near an ear of the passenger allows detection of the error signal e(i) that has a high correlation with noise N0 audible to the passenger.

Active noise reduction device 4 is constructed within a signal-processing device (a microcomputer or a DSP (Digital Signal Processor)). Cancel signal generation block 115, Chat 6, and LMS operation unit 7 operate at discrete time intervals of a sampling period $T_s$. In the present exemplary embodiment, although processing of cancel signal generation block 115, Chat 6, and LMS operation unit 7 is performed by software, such processing may be performed not only by software but also by a circuit dedicated to each section. In addition, active noise reduction device 4 may be provided with a block for generating the reference signal x(i) from information other than the reference signal x(i), and for outputting the reference signal x(i) to reference signal input terminal 41.

In the above configuration, active noise reduction device 4 outputs the cancel signal y(i) corresponding to the reference signal x(i) and the error signal e(i) from output terminal 42. As a result, cancel sound source 2 generates cancel sound N1 corresponding to the cancel signal y(i) in space S1. This allows cancel sound N1 to interfere with noise N0 in space S1, and to reduce noise N0 in space S1.

The noise generated during traveling of automobile 102 typically contains noise resulting from various causes. Examples of the noise include a muffled sound caused by engine rotation, a noise resulting from a tire, and further include noise caused by vibration of components, such as an axle, a tire house, a knuckle, an arm, a sub frame, and a body. Particularly, automobile 102 as in this example has a very large number of factors in generation of noise N0 during traveling. For this reason, the generated noise has a wide frequency band.

In order to reduce noise N0 having such a wide frequency range, cancel signal generation block 115 includes ADF 5. ADF 5 includes a finite impulse response (hereinafter, FIR) filter that includes N filter coefficients w(k), (k =0, 1, . . . , N−1). Values of the filter coefficients w(k) are updated by a filtered X-LMS (hereinafter, FxLMS) algorithm every sampling period $T_s$.

ADF 5 determines the cancel signal y(n) by using the current filter coefficient w(k,n) and the reference signal x(i). That is, the current cancel signal y(n) is determined by performing a filtering operation (convolution operation) on the filter coefficient w(k,n) and the reference signal x(i), as expressed by Formula 4.

$$y(n) = \sum_{k=0}^{N-1} w(k, n) \cdot x(n-k) = W^T(n)X(n) \quad \text{(Formula 4)}$$

Chat 6 stores the simulated acoustic transfer characteristic data C^ that simulates the acoustic transfer characteristic C of the signal transfer path of the cancel signal y(i). The signal transfer path mentioned here refers to a signal path from cancel signal generation block 115 to LMS operation unit 7. The signal transfer path according to the present exemplary embodiment refers to a path from output of the cancel signal y(i) from cancel signal generation block 115 to arrival of the error signal e(i) at LMS operation unit 7. The acoustic transfer characteristic C is a characteristic, such as a delay time (phase variations), of the cancel signal y(i) in the signal transfer path, and gain variations.

In addition to cancel sound source 2, error signal source 3, and space S1, the signal transfer path may also include a filter, a digital-to-analog (hereinafter, D/A) converter, an analog-to-digital (hereinafter, A/D) converter, and the like. Output terminal 42 of this example includes a D/A converter, whereas cancel sound source 2 includes a filter. Meanwhile, error signal source 3 includes a filter, whereas error signal input terminal 43 includes an A/D converter. That is, in addition to the characteristic of cancel sound source 2 from cancel signal generation block 105 to LMS operation unit 7, and to an acoustic characteristic of space S1, the acoustic transfer characteristic C may include a characteristic of the filter included in the signal transfer path, a signal delay due to D/A conversion and A/D conversion, and the like.

The simulated acoustic transfer characteristic data C^ of the present exemplary embodiment is represented as a vector with $N_c$ rows and one column, as expressed by Formula 5. That is, the simulated acoustic transfer characteristic data C^includes simulated acoustic transfer characteristic data $c^\wedge(k_c)$ that is $N_c$ time-invariant FIR filter coefficients, ($k_c$=0, 1, . . . , $N_c$−1). The simulated acoustic transfer characteristic data C^can be used by updating or correction. The simulated acoustic transfer characteristic data C^ may be the simulated acoustic transfer characteristic data $c^\wedge(k_c,i)$ that is time-variant filter coefficients that vary with time.

$$C^\wedge=[c^\wedge(0),c^\wedge(1), \ldots ,c^\wedge(N_c-1)]^T \quad \text{(Formula 5)}$$

Chat 6 produces the current filtered reference signal r(n) that is obtained by performing a filtering operation, that is, a convolution operation expressed by Formula 6 on the simulated acoustic transfer characteristic data C^expressed by Formula 5 and the reference signal X(n).

$$r(n) = \sum_{k_c=0}^{N_c-1} c^\wedge(k_c) \cdot x(n-k_c) = C^{\wedge T} X(n) \quad \text{(Formula 6)}$$

The reference signal X(n) includes $N_c$ reference signals x(i) at the past from the current n-th step by ($N_c$−1) steps, as expressed by Formula 7.

$$X(n)=[x(n),x(n-1), \ldots ,x(n-(N_c-1))]^T \quad \text{(Formula 7)}$$

LMS operation unit 7 receives the current filtered reference signal r(n) expressed by Formula 6, and generates the filtered reference signal R(n). For this purpose, storage unit 11 stores the (N−1) filtered reference signals r(n−1), . . . , r(n−(N−1)) from the last time that is (n−1)-th step which is the past from the current time by (N−1) steps. LMS operation unit 7 uses these N filtered reference signals r(i) to prepare the filtered reference signal R(n) that is a vector with N rows and one column, as expressed by Formula 8.

$$R(n)=[r(n),r(n-1), \ldots ,r(n-(N-1))]^T \quad \text{(Formula 8)}$$

The current filter coefficient W(n) is represented as a vector matrix with N rows and one column, composed of N filter coefficients w(k,n), (k=0, 1, . . . , N−1), as expressed by Formula 9.

$$W(n)=[w(0,n),w(1,n), \ldots ,w(N-1,n)]^T \quad \text{(Formula 9)}$$

LMS operation unit 7 uses the current error signal e(n), the filtered reference signal R(n), the step size parameter μ, and the current filter coefficient W(n) to calculate the filter coefficient W(n+1) that ADF 5 will use next time, as expressed by Formula 10.

$$W(n+1)=W(n)-\mu \cdot e(n) \cdot R(n) \quad \text{(Formula 10)}$$

Accordingly, the next filter coefficient W(n+1) is generated based on the filter coefficient W(n) calculated last time by LMS operation unit 7. As a result, ADF 5 continues adaptive control next time with the filter coefficient W(n+1).

Level detection unit 10 has the reference signal x(i) input thereto. Level detection unit 10 then detects the signal level $L_x(n)$ of the reference signal x(i), and outputs the detected signal level $L_x(n)$ to control block 8. Level detection unit 10 of the present exemplary embodiment is formed within the signal-processing device. However, level detection unit 10 may be provided outside the signal-processing device. Alternatively, level detection unit 10 may be provided outside active noise reduction device 4. In this case, active noise reduction device 4 has a terminal for supplying an output of level detection unit 10 to control block 8, separately from reference signal input terminal 41. Level detection unit 10 is provided between this terminal and reference signal source 1.

Control block 8 has the signal level $L_x(i)$ input thereto. The signal level $L_x(i)$ of the reference signal x(i) is detected by level detection unit 10. Control block 8 determines whether the input current signal level $L_x(n)$ is equal to or less than a predetermined value. Control block 8 determines that the level of the reference signal x(n) is small if the value of the signal level $L_x(n)$ is equal to or less than the predetermined value.

As a result, if determining that the signal level $L_x(n)$ is small, control block 8 outputs a control signal for adjusting the level of the cancel signal y(n).

Cancel signal generation block 115 further includes adjustment unit 9 having the control signal input thereto. The control signal is output from control block 8. Based on this control signal, adjustment unit 9 adjusts the level of the cancel signal y(n). If control block 8 determines that the signal level $L_x(n)$ is small, adjustment unit 9 decreases the level of the cancel signal y(n). That is, control block 8 adjusts the level of the cancel signal y(i) via adjustment unit 9. The above configuration allows control block 8 to indirectly adjust the level of the cancel signal y(i).

Cancel signal generation block 105 of the first example of Embodiment 1 includes adjustment unit 9. This configuration allows cancel signal generation block 105 to adjust the level of the cancel signal y(i) based on a result of determination made by control block 8.

Control block 8 of this example outputs a level adjustment coefficient α(i) as the control signal. Adjustment unit 9 can adjust the level of the cancel signal y(n) by multiplying the cancel signal y(n) by the level adjustment coefficient α(n), as expressed by Formula 11.

$$y(n)=\alpha(n)\cdot y(n) \quad \text{(Formula 11)}$$

If determining that the signal level $L_x(n)$ is small, control block 8 varies the value of the level adjustment coefficient α(n) so that the level of the cancel signal y(n) decreases. This configuration decreases the level of the cancel signal y(n) that is output from cancel signal generation block 115. If determining that the signal level $L_x(n)$ is small, control block 8 changes the current level adjustment coefficient α(n), for example, into a value smaller than the last level adjustment coefficient α(n−1).

As expressed by Formula 12, an operation of multiplying the cancel signal y(n) by the level adjustment coefficient α(n) is synonymous with an operation of multiplying the reference signal x(i) or filter coefficient w(k,n) by the level adjustment coefficient α(n) in the operation expressed by Formula 4 performed by ADF 5. Accordingly, adjustment unit 9 can adjust the level of the cancel signal y(n) by adjusting at least one of the cancel signal y(n), the reference signal x(i), and the filter coefficient w(k,n).

$$\begin{aligned} y(n) &= \alpha(n)\sum_{k=0}^{N-1} w(k,n)\cdot x(n-k) \\ &= \sum_{k=0}^{N-1} w(k,n)\cdot(\alpha(n)\cdot x(n-k)) \\ &= \sum_{k=0}^{N-1} (\alpha(n)\cdot w(k,n))\cdot x(n-k) \end{aligned} \quad \text{(Formula 12)}$$

The aforementioned configuration allows cancel signal generation block 105 to generate the cancel signal y(i), as expressed by Formula 12. As a result, cancel signal generation block 115 can vary the level of the cancel signal y(i) depending on the value of the level adjustment coefficient α(i). Therefore, control block 8 can decrease the level of the cancel signal y(i) by decreasing the value of the level adjustment coefficient α(i).

Adjustment unit 9 in this example, which is a multiplier for multiplying the level adjustment coefficient α(i), may use an amplitude adjuster, a variable gain amplifier, and the like. In this case, in response to the control signal that is output from control block 8, adjustment unit 9 varies amplitude or gain of the cancel signal y(i) that is output from cancel signal generation block 115, the reference signal x(i) that is input into cancel signal generation block 115, and the filter coefficient w(k,i).

Adjustment unit 9 may be separately provided outside cancel signal generation block 115. For example, if adjustment unit 9 adjusts the level of the cancel signal y(i), adjustment unit 9 may be provided between cancel signal generation block 115 and output terminal 42. Alternatively, adjustment unit 9 may be included in output terminal 42. Furthermore, adjustment unit 9 may be provided outside active noise reduction device 4. For example, adjustment unit 9 may be included in cancel sound source 2.

If adjustment unit 9 is configured to adjust the reference signal x(i), adjustment unit 9 may be provided between cancel signal generation block 115 and reference signal input terminal 41. Alternatively, adjustment unit 9 may be included in reference signal input terminal 41 or reference signal source 1.

If adjustment unit 9 is configured to adjust the filter coefficient W(i), adjustment unit 9 may be provided between cancel signal generation block 115 and LMS operation unit 7. Alternatively, adjustment unit 9 may be included in LMS operation unit 7.

Moreover, control block 8 may include adjustment unit 9. If control block 8 multiplies the cancel signal y(i) by the level adjustment coefficient α(i) to adjust the cancel signal y(i), control block 8 is provided between cancel signal generation block 115 and output terminal 42. In this case, control block 8 does not need to output the level adjustment coefficient α(i).

In a normal state, that is, if control block 8 determines that the signal level $L_x(n)$ is not small, control block 8 outputs 1 as a value of the level adjustment coefficient α(n). If determining that the signal level $L_x(n)$ is small, control block 8 reads the level adjustment coefficient α(n) ($0 \le \alpha(n) < 1$) from storage unit 11, and outputs the level adjustment coefficient α(n). The level adjustment coefficient α(n) is stored in storage unit 11 in advance.

Although the value of the level adjustment coefficient α(i) of this example is a fixed value, a variable value may be used. For example, if determining that the signal level $L_x(n)$ is equal to or less than the predetermined value, the control block may change the level adjustment coefficient α(n) in accordance with the signal level $L_x(n)$. Note that, also in this case, the level adjustment coefficient α(n) is adjusted in a range of $0 \le \alpha(n) < 1$.

If determining that the signal level $L_x(n)$ is small, control block 8 of this example adjusts the level adjustment coefficient α(n) to zero. This configuration allows control block 8 to stop cancel sound N1, and thus controlling generation of the abnormal sound. Since the level of noise N0 is small while the signal level $L_x(i)$ is small, noise N0 is not much annoying even if the output of cancel sound N1 is stopped.

Although the level adjustment coefficient α(i) is 0 in the present exemplary embodiment, the present exemplary embodiment is not limited to this case. The level adjustment coefficient $\alpha(i)$ may have a value in a range in which the abnormal sound caused by the cancel signal y(i) is not practically grating.

According to the above configuration, if determining that the signal level $L_x(i)$ is small, control block 8 adjusts the value of the level adjustment coefficient $\alpha(i)$ to a value smaller than 1. As a result, the level of the cancel signal y(i) can be adjusted to be small. Since the sound generated by the reference signal noise $x_z(i)$ can be adjusted to be small accordingly, the abnormal sound generated by the reference signal noise $x_z(i)$ can be controlled even if noise N0 is small. Therefore, active noise reduction device 4 capable of reducing noise N0 well can be provided.

However, if the cancel signal y(i) is adjusted to be small, or if the output of cancel sound N1 is stopped as described above, the filter coefficient W(i) may become excessive, and in a worst case, the filter coefficient W(i) may diverge. The filter coefficient W(i) diverges because LMS operation unit 7 updates the filter coefficient W(i) to compensate the decreased cancel signal y(i). Meanwhile, if the cancel signal y(i) is not adjusted, the filter coefficient W(i) will be updated to cancel the reference signal noise $x_z(i)$ that has no correlation with the noise, and thus the abnormal sound may become larger.

In order to improve the foregoing, if control block 8 determines that the signal level $L_x(i)$ is small, LMS operation unit 7 calculates the next filter coefficient W(n+1) by using the level adjustment coefficient $\alpha(n)$, as expressed by Formula 13.

$$W(n+1)=W(n)-\alpha(n)\cdot\mu\cdot e(n)\cdot R(n) \quad \text{(Formula 13)}$$

This configuration causes the next filter coefficient W(n+1) to be updated based on the error signal e(n), the filtered reference signal R(n), the step size parameter $\mu$, and the level adjustment coefficient $\alpha(n)$. Therefore, even if the level of the cancel signal y(n) becomes small, rapid updating of the filter coefficient W(n+1) is controlled. Moreover, LMS operation unit 7 may be configured to adjust at least one of the error signal e(n), the filtered reference signal R(n), the step size parameter $\mu$, and the level adjustment coefficient $\alpha(n)$ to zero. In this case, it is possible to prevent the filter coefficient W(n+1) from being erroneously updated to a larger value, or from being updated to a value that is based on the reference signal noise $x_z(i)$.

Figure 4:
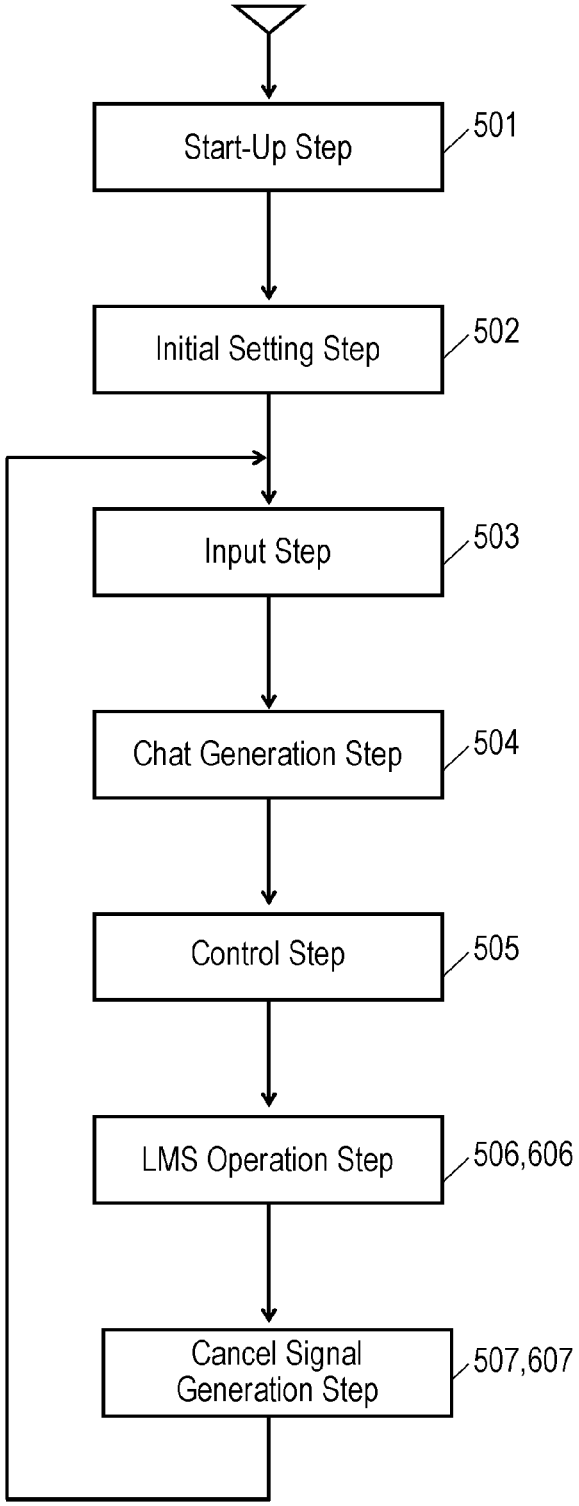
FIG. 4 is a flow chart of an operation of the active noise reduction device of the second and fourth examples according to Embodiment 1.
Figure 5:
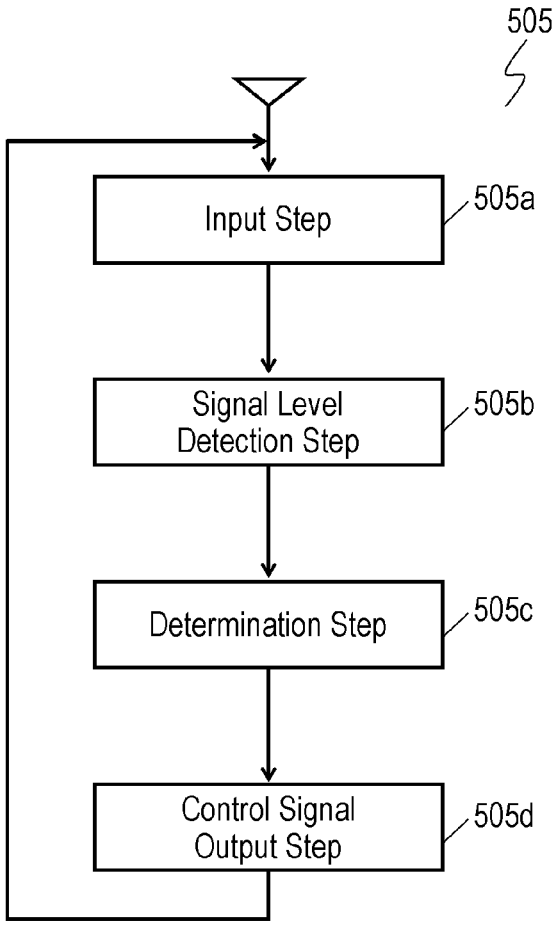
FIG. 5 is a flow chart of the operation of the active noise reduction device of the second example according to Embodiment 1.
Figure 6:
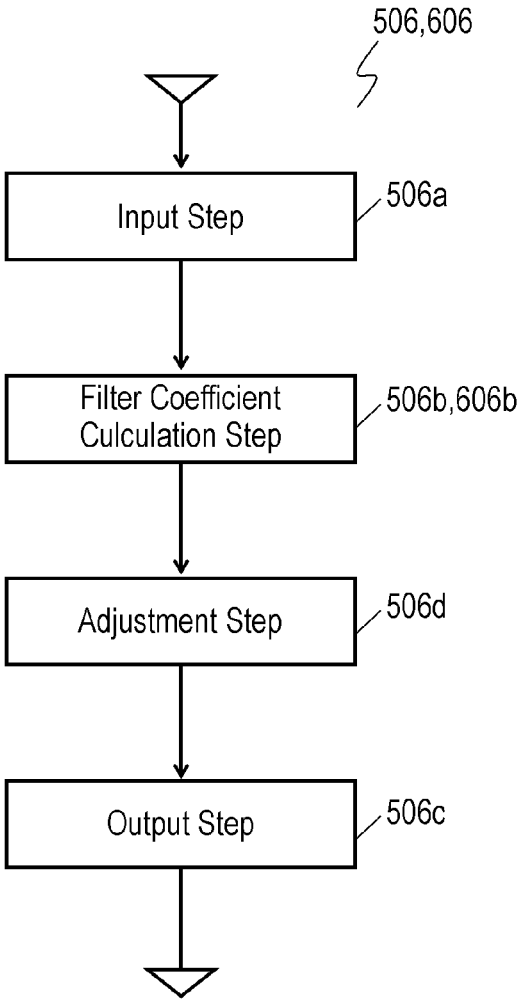
FIG. 6 is a flow chart of the operation of the active noise reduction device of the second example according to Embodiment 1.
Figure 7A:
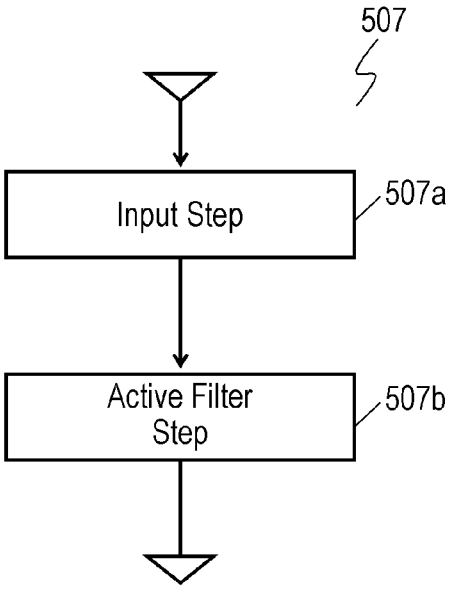
FIG. 7A is a flow chart of the operation of the active noise reduction device of the second example according to Embodiment 1.

A procedure and operation for reducing noise N0 will be described below with reference to the drawings in active noise reduction device 4 according to the present exemplary embodiment. FIG. 4 is a control flow chart of active noise reduction device 4 of this example. FIG. 5 is a control flow chart of a control step. FIG. 6 is a control flow chart of an LMS operation step. FIG. 7A is a control flow chart of a cancel signal generation step.

The control flow chart illustrated in FIG. 4 is a main routine of active noise reduction device 4 for reducing noise N0 in active noise reduction device 4 of this example. This main routine includes start-up step 501, initial setting step 502, input step 503, Chat generation step 504, control step 505, LMS operation step 506, and cancel signal generation step 507.

Chat generation step 504 is executed by Chat 6 illustrated in FIG. 2. Control step 505 is executed by control block 8 illustrated in FIG. 2. LMS operation step 506 is executed by LMS operation unit 7 illustrated in FIG. 2. Cancel signal generation step 507 is executed by cancel signal generation block 115 illustrated in FIG. 2.

In start-up step 501, a power of active noise reduction device 4 is turned on, and active noise reduction device 4 starts an operation. In initial setting step 502, active noise reduction device 4 reads data, such as an initial value W(0), of the filter coefficient W(i) and simulated acoustic transfer characteristic data Ĉ stored in storage unit 11. In input step 503, the reference signal x(n) and the error signal e(n) are input to active noise reduction device 4.

In Chat generation step 504, active noise reduction device 4 prepares the reference signal X(n) from the input reference signal x(n). Moreover, in Chat generation step 504, active noise reduction device 4 generates the filtered reference signal r(n) by correcting the reference signal X(n) with the simulated acoustic transfer characteristic data Ĉ. Although Chat generation step 504 of this example is executed in the main flow chart, Chat generation step 504 is not limited to this case, and may be executed as a subroutine. Note that, Chat generation step 504 is executed before LMS operation step 506. Parallel processing of the Chat generation routine in this way allows the operation to be executed in a short time, leading to shorter sampling period $T_s$. Therefore, noise N0 can be reduced precisely and quickly.

In control step 505, active noise reduction device 4 detects the level of the input reference signal x(n). If determining that the level of the reference signal x(n) is small, active noise reduction device 4 generates the control signal for adjusting the level of the cancel signal y(n). For this purpose, control step 505 includes input step 505*a*, signal level detection step 505*b*, determination step 505*c*, and control signal output step 505*d*, as illustrated in FIG. 5.

In input step 505*a*, active noise reduction device 4 receives the reference signal x(n), and reads, from storage unit 11, the reference signals $(x(n-1), \ldots, x(n-\gamma_x))$ at the past from the current time by $\gamma_x$ steps.

In signal level detection step 505*b*, active noise reduction device 4 detects the signal level $L_x(n)$ from the reference signals $(x(n), \ldots, x(n-\gamma_x))$ prepared in input step 505*a*.

In determination step 505*c*, active noise reduction device 4 compares the signal level $L_x(n)$ with the predetermined value. In determination step 505*c*, active noise reduction device 4 determines that the level of the reference signal x(n) is small if the signal level $L_x(n)$ is smaller than the predetermined value.

In control signal output step 505*d*, if it is determined in determination step 505*c* that the level of the reference signal x(n) is small, active noise reduction device 4 outputs the control signal for decreasing the cancel signal y(n).

In control signal output step 505*d* of control step 505 corresponding to the second example of the present exemplary embodiment, active noise reduction device 4 outputs the level adjustment coefficient $\alpha(n)$ as the control signal.

In control signal output step 505*d*, in a normal state, that is, if it is determined in determination step 505*c* that the signal level $L_x(n)$ is not small, active noise reduction device 4 outputs the level adjustment coefficient $\alpha(n)$ as 1. On the other hand, if it is determined in determination step 505*c* that the signal level $L_x(n)$ is small, active noise reduction device 4 reads the level adjustment coefficient $\alpha(n)$ stored in storage unit 11 in advance. In control signal output step 505*d*, if it is determined in determination step 505*c* that the signal level $L_x(i)$ is equal to or less than the predetermined value, the level adjustment coefficient $\alpha(i)$ may be varied to a value corresponding to the signal level $L_x(i)$. Note that, in this case, the level adjustment coefficient $\alpha(i)$ is varied within a range of $0 \leq \alpha(i) < 1$. Moreover, in control signal output step 505*d*, if it is determined in determination step 505*c* that the signal level $L_x(i)$ is small, the level adjustment coefficient $\alpha(i)$ may be output as 0.

Although control step 505 of this example is executed in the main flow chart, control step 505 is not limited to this case, and may be executed as a subroutine. In this case, control step 505 is executed before LMS operation step 506. In this case, for example, the routine of control step 505 can also be processed in parallel with the main routine. As a result, active noise reduction device 4 can execute the operation in a short time, leading to shorter sampling period $T_s$. Therefore, noise N0 can be reduced precisely and quickly.

In LMS operation step 506 illustrated in FIG. 4 and FIG. 6, active noise reduction device 4 prepares the filtered reference signal R(n) from the filtered reference signal r(n). Moreover, in LMS operation step 506, active noise reduction device 4 calculates the next filter coefficient W(n+1) by using the received error signal e(n), the filtered reference signal R(n), the current filter coefficient W(n), and the step size parameter μ, as expressed by Formula 10.

For this purpose, LMS operation step 506 includes input step 506*a*, filter coefficient calculation step 506*b*, and output step 506*c*.

In input step 506*a*, active noise reduction device 4 receives the error signal e(n), the filtered reference signal r(n), and the control signal. Active noise reduction device 4 further reads the filter coefficient W(n) from storage unit 11. Active noise reduction device 4 then generates the filtered reference signal R(n) by using the filtered reference signal r(n). The filter coefficient W(n) is the filter coefficient calculated in LMS operation step 506 in the last (n−1)-th step. In input step 506*a*, if the control signal for decreasing the cancel signal y(n) is received, active noise reduction device 4 may adjust the step size parameter μ to zero.

In filter coefficient calculation step 506*b*, active noise reduction device 4 calculates the next filter coefficient W(n+1) based on the received error signal e(n), the filtered reference signal R(n), the step size parameter μ, and the filter coefficient W(n), as expressed by Formula 10. In output step 506*c*, active noise reduction device 4 stores, in storage unit 11, the filter coefficient W(n+1) calculated in filter coefficient calculation step 506*b*.

In LMS operation step 506, active noise reduction device 4 may calculate the next filter coefficient W(n+1) as expressed by Formula 13. In this case, in input step 506*a*, the level adjustment coefficient α(n) is further received. In input step 506*a*, if the received level adjustment coefficient α(n) is smaller than a predetermined value, active noise reduction device 4 may adjust the step size parameter μ to zero.

In filter coefficient calculation step 506*b*, active noise reduction device 4 calculates the next filter coefficient W(n+1) based on the received error signal e(n), the filtered reference signal R(n), the step size parameter μ, the filter coefficient W(n), and the level adjustment coefficient α(n), as expressed by Formula 13.

LMS operation step 506 may further include adjustment step 506*d*. In adjustment step 506*d*, active noise reduction device 4 adjusts magnitude of the filter coefficient W(n) to output, based on the control signal that is output in control step 505. At this time, the filter coefficient W(n) to be used in next LMS operation step 506 is not adjusted.

If the level adjustment coefficient α(n) is input as the control signal, the filter coefficient W(n) may be multiplied by the level adjustment coefficient α(n) in adjustment step 506*d*. In adjustment step 506*d*, if the level adjustment coefficient α(n) is small, the filter coefficient W(n) may be adjusted to zero.

In cancel signal generation step 507 illustrated in FIG. 4 and FIG. 7A, active noise reduction device 4 generates and outputs the cancel signal y(n) to output terminal 42, based on the filter coefficient W(n) calculated in LMS operation step 506 and reference signal X(n), and on the control signal that is output in the control step. Then, active noise reduction device 4 performs adaptive control by returning to input step 503 after cancel signal generation step 507.

Cancel signal generation step 507 includes input step 507*a* and adaptive filter step 507*b*. In input step 507*a*, active noise reduction device 4 receives the reference signal x(n) and the control signal, and generates the reference signal X(n). Moreover, in input step 507*a*, active noise reduction device 4 reads the filter coefficient W(n) from storage unit 11.

In adaptive filter step 507*b*, active noise reduction device 4 generates and outputs the cancel signal y(n) to output terminal 42, based on the reference signal X(n), the read filter coefficient W(n), and the control signal. In input step 507*a* of this example, the level adjustment coefficient α(n) is input as the control signal. In adaptive filter step 507*b*, active noise reduction device 4 generates the cancel signal y(n), as expressed by Formula 11 and Formula 12.

In adaptive filter step 507*b*, if the level adjustment coefficient α(n) is small, the cancel signal y(n) may be adjusted to zero. Alternatively, if it is determined in control step 505 that the level adjustment coefficient α(n) is smaller than the predetermined value, active noise reduction device 4 may multiply the cancel signal y(n) by the level adjustment coefficient α(n) in adaptive filter step 507*b*, as expressed by Formula 11.

In input step 507*a*, if the input level adjustment coefficient α(n) is small, one of the reference signal X(n) and the filter coefficient W(n) may be adjusted to zero. Alternatively, active noise reduction device 4 may multiply one of the reference signal X(n) and the filter coefficient W(n) by the level adjustment coefficient α(n) in input step 507*a*. In this case, in input step 507*a*, if the level adjustment coefficient α(n) is smaller than the predetermined value, active noise reduction device 4 determines that the level adjustment coefficient α(n) is small.

According to the above configuration, if it is determined in control step 505 that the signal level $L_x(i)$ of the reference signal is small, the level adjustment coefficient α(i) has a value smaller than 1. Therefore, the level of the cancel signal y(i) decreases. As a result, the noise sound resulting from the reference signal noise $x_z(i)$ contained in cancel sound N1 can also be decreased, and thus generation of the abnormal sound resulting from the reference signal noise $x_z(i)$ can be controlled even if noise N0 is small. Therefore, active noise reduction device 4 capable of reducing noise N0 well can be implemented.

Figure 7B:
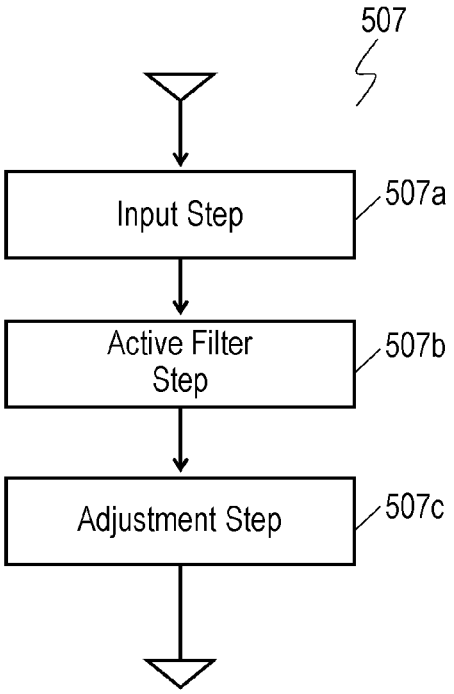
FIG. 7B is a flow chart of another operation of the active noise reduction device of the second example according to Embodiment 1.

FIG. 7B is another control flow chart of the cancel signal generation step. In the operation illustrated in FIG. 7A, the level of the cancel signal y(i) is adjusted in adaptive filter step 507*b* or input step 507*a*. In the control operation illustrated in FIG. 7B, the level of the cancel signal y(i) is adjusted in separately provided adjustment step 507*c*.

If the cancel signal y(i) is multiplied by the level adjustment coefficient α(i) or if the cancel signal y(i) is adjusted to zero in adjustment step 507*c*, adjustment step 507*c* is executed after adaptive filter step 507*b*. Adjustment step 507*c* may not be included in cancel signal generation step 507 and may be executed after cancel signal generation step 507.

If the reference signal X(i) or the filter coefficient W(i) is multiplied by the level adjustment coefficient α(i) in adjustment step 507*c*, or if the reference signal X(i) or the filter coefficient W(i) is adjusted to zero, adjustment step 507*c* is executed before adaptive filter step 507*b*. Adjustment step 507*c* may not be included in cancel signal generation step 507 and may be executed before cancel signal generation step 507.

Next, level detection unit 120 of the third example according to Embodiment 1 will be described. As illustrated in FIG. 2, control block 128 of this third example includes level detection unit 120. Level detection unit 120 detects the level of the reference signal noise $x_z(i)$ contained in the reference signal x(i). Control block 128 then determines the level of the reference signal x(i) by using the level of the reference signal noise $x_z(i)$ detected by level detection unit 120.

Figure 8:
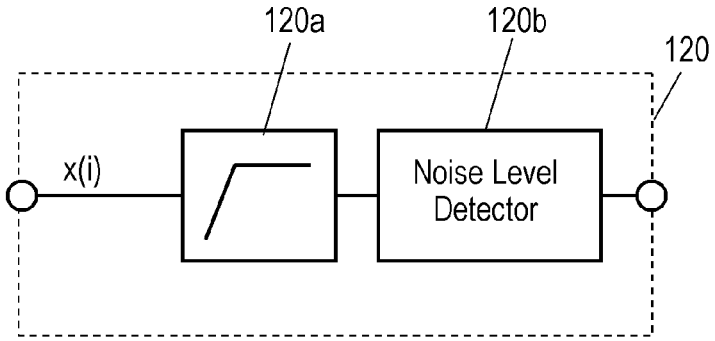
FIG. 8 is a block diagram of a level detection unit of the third example of Embodiment 1.
Figure 9A:
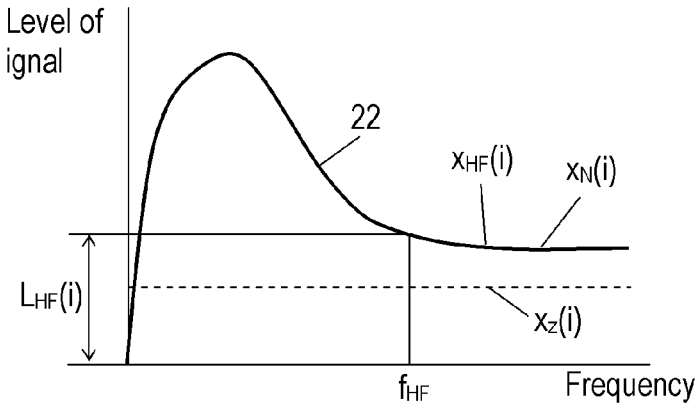
FIG. 9A is a diagram illustrating a frequency characteristic of a reference signal of the active noise reduction device of the third example according to Embodiment 1.
Figure 9B:
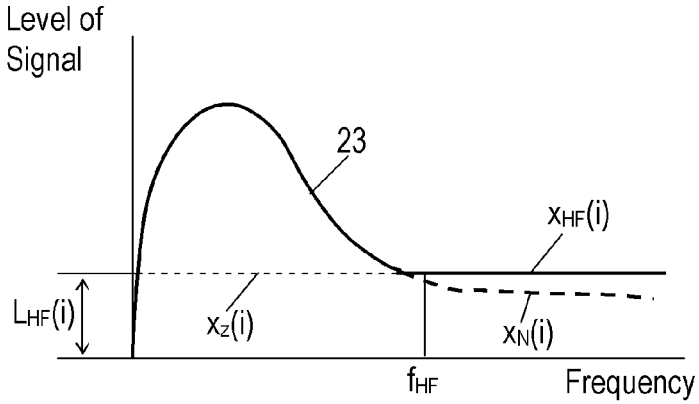
FIG. 9B is a diagram illustrating the frequency characteristic of the reference signal of the active noise reduction device of the third example according to Embodiment 1.

FIG. 8 is a block diagram of level detection unit 120 in the third example. FIG. 9A and FIG. 9B are diagrams each illustrating a frequency characteristic of the reference signal x(i) that is input into reference signal input terminal 41. In FIG. 9A and FIG. 9B, the horizontal axis represents the frequency and the vertical axis represents the signal level. Characteristic curve 22 illustrated in FIG. 9A and characteristic curve 23 illustrated in FIG. 9B each represent the frequency characteristic of the reference signal x(i). FIG. 9A is a characteristic diagram while the signal level $L_x(i)$ of the reference signal x(i) is large, whereas FIG. 9B is a characteristic diagram while the signal level $L_x(i)$ of the reference signal x(i) is small.

Level detection unit 120 receives the current reference signal x(n). Level detection unit 120 detects a level $L_{HF}(n)$ of a high-frequency component signal $x_{HF}(n)$ contained in the received reference signal x(n), and outputs the level $L_{HF}(n)$ to control block 128. For this purpose, level detection unit 120 includes high pass filter (hereinafter, HPF) 120*a* and noise level detector 120*b*, as illustrated in FIG. 8. The output of HPF 120*a* is then supplied to noise level detector 120*b*. In the present exemplary embodiment, a cut-off frequency of HPF 120*a* is $f_{HF}$. A band pass filter (hereinafter, BPF) may be used instead of HPF 120*a*. In this case, the lower cut-off frequency of BPF is defined to be the frequency $f_{HF}$.

HPF 120*a* receives the reference signal x(i), and outputs a high-frequency component signal $x_{HF}(n)$ having a frequency equal to or higher than the frequency flu, to noise level detector 120*b*. HPF 120*a* is, for example, a digital filter, and performs a convolution operation on the reference signals x(n), . . . , $x(n-\gamma_{HF})$ at the past from the current time by $\gamma_{HF}$ steps, and a coefficient of the digital filter. This configuration allows noise level detector 120*b* to detect the signal level $L_{HF}(n)$ of the high-frequency component signal $x_{HF}(n)$.

Typically, active noise reduction systems are effective in reduction of a low-frequency band noise compared with reduction of a high-frequency band noise. Therefore, in order to prevent a folding noise from occurring, reference signal source 1 or reference signal input terminal 41 includes a low pass filter (hereinafter, LPF) or the like. Moreover, in apparatuses, such as automobile 102, of the present exemplary embodiment, the low-frequency band noise is more conspicuous than the high-frequency band noise in many cases. Given these factors, the level of the reference signal x(i) becomes smaller as the frequency is higher as in characteristic curve 22 illustrated in FIG. 9A and characteristic curve 23 illustrated in FIG. 9B.

As illustrated in FIG. 9A, if noise N0 is large and the signal level $L_x(i)$ of the reference signal x(i) is large, the component of the noise component signal $x_N(i)$ is larger than the level of the reference signal noise $x_z(i)$ also in the high frequency band. Accordingly, in active noise reduction system 101 that reduces the wide-frequency-band noise as in the present exemplary embodiment, the filter coefficient W(i) of ADF 5 is updated to reduce the noise component signal $x_N(i)$ of the high frequency band as well. Consequently, if the signal level $L_x(i)$ of the reference signal x(i) is large, active noise reduction system 101 can reduce the wide-frequency-band noise well.

However, as illustrated in characteristic curve 23 of FIG. 9B, if noise N0 is small, the noise component signal $x_N(i)$ may be smaller than the level of the reference signal noise $x_z(i)$ in some band of the reference signal x(i). In this case, the cancel signal y(i) contains a component that is based on the reference signal noise $x_z(i)$ in the band where the reference signal noise $x_z(i)$ is larger than the noise component signal $x_N(i)$ within a control band. Consequently, the abnormal sound is generated by the signal based on the reference signal noise $x_z(i)$.

Here, the cut-off frequency $f_{HF}$ of HPF 120*a* is defined such that the reference signal noise $x_z(i)$ is larger than the noise component signal $x_N(i)$ at frequencies equal to or higher than the cut-off frequency $f_{HF}$ if the signal level $L_x(i)$ of the reference signal x(i) is smaller than a certain level. Accordingly, the signal level $L_{HF}(i)$ of the high-frequency component signal $x_{HF}(i)$ is equal to the signal level $L_z(i)$ of the reference signal noise $x_z(i)$. As a result, noise level detector 120*b* can detect the signal level $L_{HF}(i)$ of the high-frequency component signal $x_{HF}(i)$ as the reference signal noise $x_z(i)$. Level detection unit 120 then outputs the value of the detected signal level $L_{HF}(i)$ of the high-frequency component signal $x_{HF}(i)$ to control block 128.

Accordingly, control block 128 determines that the level of the reference signal x(i) is small if the signal level $L_{HF}(i)$ of the high-frequency component signal $x_{HF}(i)$ is smaller than the signal level $L_z(i)$ of the reference signal noise $x_z(i)$. In consideration of variations in the signal level $L_z(i)$ of the reference signal noise $x_z(i)$ or the like, a threshold is set in advance for control block 128 to determine that the reference signal x(i) is small. Control block 128 then determines whether the signal level $L_{HF}(i)$ is smaller than the predetermined threshold. The aforementioned configuration allows control block 128 to determine that the level of the reference signal x(i) is small if control block 128 detects that the signal level $L_{HF}(i)$ is equal to or less than the predetermined threshold. Although it is assumed that the cut-off frequency $f_{HF}$ of HPF 120*a* is fixed, for example the cut-off frequency flu may be varied depending on magnitude of the signal level $L_x(i)$ of the reference signal x(i).

Both HPF 120*a* and noise level detector 120*b* of the present exemplary embodiment are constituted within the signal-processing device. However, all or part of level detection unit 120 may be constituted outside the signal-processing device. Alternatively, all or part of level detection unit 120 may be included in reference signal source 1 or reference signal input terminal 41.

For example, if reference signal source 1 includes HPF 120*a*, reference signal source 1 outputs the reference signal x(i) and the high-frequency component signal $x_{HF}(i)$ to active noise reduction device 4. In this case, in order to supply the high-frequency component signal $x_{HF}(i)$ to noise level detector 120*b*, active noise reduction device 4 is provided with a terminal for inputting the high-frequency component signal $x_{HF}(i)$. HPF 120*a* can be made of an analog filter using an operational amplifier, a capacitor, and the like.

Alternatively, if reference signal source 1 includes all of HPF 120*a* and noise level detector 120*b*, reference signal source 1 outputs the reference signal x(i), the signal level $L_x(i)$, and the signal level $L_{HF}(i)$ to active noise reduction device 4. In this case, in order to supply the signal level $L_x(i)$ and the signal level $L_{HF}(i)$ to control block 128, active noise reduction device 4 is provided with a terminal for inputting the signal levels.

The aforementioned configuration, in which control block 128 uses the signal level $L_{HF}(i)$ of the high-frequency component signal $x_{HF}(i)$ to determine the signal level $L_x(i)$ of the reference signal x(i), allows control block 128 to determine a state in which the abnormal sound is generated more accurately.

In this case, in signal level detection step 505*b* illustrated in FIG. 5, active noise reduction device 4 extracts the high-frequency component signal $x_{HF}(i)$ having a frequency equal to or higher than the frequency $f_{HF}$ from the reference signal x(i) by using the HPF or BPF having the cut-off frequency flu. Moreover, in signal level detection step 505*b*, active noise reduction device 4 detects the signal level $L_{HF}(i)$ of the extracted high-frequency component signal $x_{HF}(i)$.

In determination step 505*c*, active noise reduction device 4 compares the signal level $L_{HF}(i)$ of the high-frequency component signal $x_{HF}(i)$ with the threshold that corresponds to the signal level $L_z(i)$ of the reference signal noise $x_z(i)$. This allows active noise reduction device 4 to detect which is larger between the reference signal noise $x_z(i)$ and the noise component signal $x_N(i)$. In signal level determination step 505*c*, active noise reduction device 4 compares the signal level $L_{HF}(i)$ with the predetermined threshold and determines that the signal level $L_x(i)$ of the reference signal x(i) is small if determining that the signal level $L_{HF}(i)$ is smaller than the threshold.

Next, cancel signal generation block 135 of the fourth example according to Embodiment 1 will be described. In FIG. 2, cancel signal generation block 135 of the fourth example includes ADF 5 and adjustment unit 139. Adjustment unit 139 in this example receives the control signal that is output from control block 8 or control block 128, and stops the output of the cancel signal y(i) based on this control signal. In this case, if determining that the signal level $L_x(n)$ is small, control block 8 or control block 128 outputs the control signal for stopping the output of the cancel signal y(n) to adjustment unit 139.

For example, adjustment unit 139 can also be made of a switch or the like provided between ADF 5 and output terminal 42. The switch is turned on and off based on the output of control block 8 or control block 128. As a result, adjustment unit 139 can prevent the cancel signal y(i) from being output to output terminal 42.

Adjustment unit 139 may be separately provided outside cancel signal generation block 135. For example, adjustment unit 139 may be provided between cancel signal generation block 135 and output terminal 42. Alternatively, adjustment unit 139 may be included in output terminal 42. Moreover, adjustment unit 139 may be provided outside active noise reduction device 4, e.g. between output terminal 42 and cancel sound source 2.

Adjustment unit 139 may be provided between ADF 5 and reference signal input terminal 41. In this case, adjustment unit 139 stops the reference signal x(i) from being input into ADF 5. Such a configuration provides an effect identical to an effect of the configuration in which adjustment unit 139 stops the output of cancel signal y(i). In this case, adjustment unit 139 may be provided, for example, between cancel signal generation block 135 and reference signal input terminal 41. Alternatively, adjustment unit 139 may be included in one of reference signal input terminal 41 and reference signal source 1.

Next, cancel signal generation block 145 of the fifth example according to Embodiment 1 will be described. In FIG. 2, cancel signal generation block 145 of the fifth example includes ADF 5 and adjustment unit 149. Adjustment unit 149 in this example includes the LPF, and is provided, for example, between ADF 5 and output terminal 42. Adjustment unit 149 can be made of, for example, a digital filter or the like. The control signal that is output from control block 8 or control block 128 is input into adjustment unit 149. Adjustment unit 149 adjusts the level of the cancel signal y(i) based on this control signal.

If determining that the signal level $L_x(n)$ is small, control block 8 or control block 128 of this example outputs the control signal for adjusting the output of the cancel signal y(n) to adjustment unit 149. In response to the control signal that is output from control block 8 or control block 128, adjustment unit 149 changes the cut-off frequency $f_{LF}(n)$ of the LPF.

In a normal state, that is, if the signal level $L_x(i)$ is large, adjustment unit 149 sets the cut-off frequency $f_{LF}(i)$ higher than an upper limit of the control band in which noise is to be reduced. If control block 8 or control block 128 determines that the signal level $L_x(i)$ is small, adjustment unit 149 lowers the cut-off frequency $f_{LF}(i)$. In this case, the cut-off frequency $f_{LF}(i)$ is set, for example, equal to or lower than the cut-off frequency $f_{LF}(i)$ of HPF 120*a*.

Adjustment unit 149 may be configured to change the cut-off frequency $f_{LF}(i)$ in accordance with magnitude of the signal level $L_x(i)$. For example, if the signal level $L_x(n)$ is large, the cut-off frequency $f_{LF}(n)$ is set at the upper limit frequency of the control band. Then, adjustment unit 149 may calculate the current cut-off frequency $f_{LF}(n)$ by multiplying the cut-off frequency $f_{LF}(n)$ by the level adjustment coefficient $\alpha(n)$.

In this case, control block 8 or control block 128 outputs the level adjustment coefficient $\alpha(n)$ to adjustment unit 149. If control block 8 or control block 128 determines that the signal level $L_x(n)$ is large, the level adjustment coefficient $\alpha(n)$ is adjusted to 1. Meanwhile, if control block 8 or control block 128 determines that the signal level $L_x(n)$ is small, the level adjustment coefficient $\alpha(n)$ is adjusted in the range of $0 \leq \alpha(n) < 1$.

The aforementioned configuration allows the cut-off frequency $f_{LF}(i)$ of the LPF to be set at a frequency equal to or lower than the lower limit frequency $f_z(i)$ of the frequency band in which the reference signal noise $x_z(i)$ is larger than the noise component signal $x_N(i)$. This configuration causes a signal having a frequency equal to or higher than the lower limit frequency $f_z(i)$ out of the reference signal noise $x_z(i)$ to be attenuated even if the signal level $L_x(i)$ is small. Therefore, this configuration can provide active noise reduction device 4 capable of reducing noise N0 well while decreasing the level of the noise sound contained in cancel sound N1, the noise sound resulting from the reference signal noise $x_z(i)$.

Adjustment unit 149 may be provided outside cancel signal generation block 145 or active noise reduction device 4. For example, adjustment unit 149 may be provided between cancel signal generation block 145 and output terminal 42. Moreover, adjustment unit 149 may be included in one of output terminal 42 and cancel sound source 2.

Adjustment unit 149 may be provided between ADF 5 and reference signal input terminal 41. In this case, adjustment unit 149 receives the reference signal x(i) and outputs the received reference signal x(i) to ADF 5 through the LPF. This allows reduction in the reference signal noise $x_z(i)$ contained in the reference signal x(i) to be used for generation of the cancel signal y(i). Accordingly, such a configuration allows this example to obtain an effect similar to the effect of the case where adjustment unit 149 is provided after ADF 5. The LPF may use a constituted analog filter according to components, such as an operational amplifier and a resistor.

Moreover, this example can obtain a similar effect even if adjustment unit 149 is configured to convolute the filter coefficient W(i) updated by LMS operation unit 7 with the LPF formed of the digital filter.

Figure 10A:
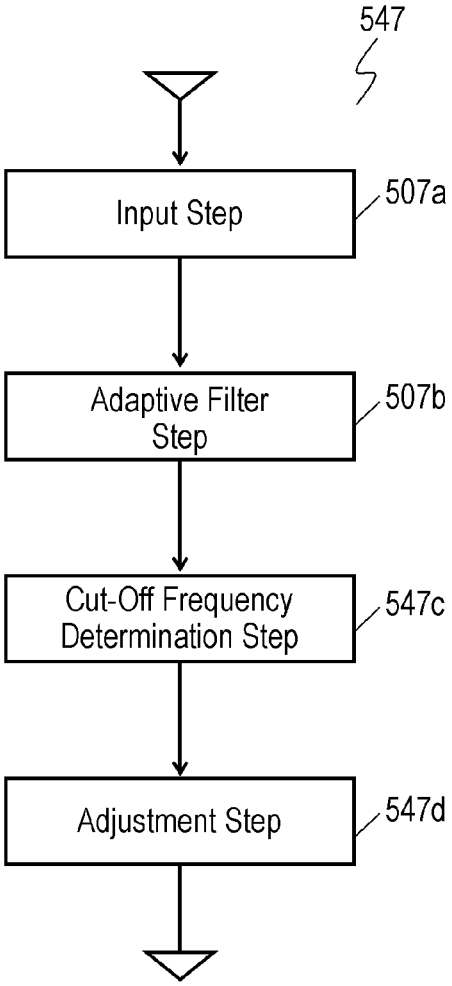
FIG. 10A is a flow chart of a cancel signal generation block of the active noise reduction device of the fifth example according to Embodiment 1.

Cancel signal generation step 547 of this example will be described. FIG. 10A is a flow chart of cancel signal generation step 547 of this example. As illustrated in FIG. 10A, cancel signal generation step 547 includes input step 507*a*, adaptive filter step 507*b*, cut-off frequency determination step 547*c*, and adjustment step 547*d*. Cancel signal generation step 547 of this example can be replaced with cancel signal generation step 507 in FIG. 4.

In adaptive filter step 507*b*, if the filter coefficient is calculated based on a signal obtained by the LPF reducing components having frequencies equal to or higher than the cut-off frequency $f_{LF}(i)$ from the reference signal x(i), adjustment step 547*d* is provided between input step 507*a* and adaptive filter step 507*b*. In addition, if the LPF changes the frequency characteristic of the filter coefficient W(n) that is read in input step 507*a* and outputs the frequency characteristic to adaptive filter step 507*b*, adjustment step 547*d* is provided between input step 507*a* and adaptive filter step 507*b*. Moreover, if the LPF reduces components having frequencies equal to or higher than the cut-off frequency $f_{LF}(i)$ from the cancel signal y(i) and outputs the cancel signal y(i) to output terminal 42, adjustment step 547*d* is provided after adaptive filter step 507*b*.

In input step 507*a*, active noise reduction device 4 receives the reference signal x(n) and the level adjustment coefficient $\alpha(n)$, and generates the reference signal X(n). Moreover, active noise reduction device 4 reads the filter coefficient W(n) from storage unit 11. In adaptive filter step 507*b*, active noise reduction device 4 uses the read filter coefficient W(n) to generate and output the cancel signal y(n) based on the reference signal X(n), as expressed by Formula 4.

If the cut-off frequency $f_{LF}(i)$ is changed, cancel signal generation step 547 includes cut-off frequency determination step 547*c*. In cut-off frequency determination step 547*c*, active noise reduction device 4 determines the cut-off frequency $f_{LF}(i)$ to be used in adjustment step 547*d* in accordance with the control output of control step 505. Cut-off frequency determination step 547*c* may be provided after input step 507*a* and before adjustment step 547*d*. For example, if it is determined in control step 505 that the signal level $L_x(n)$ is large, active noise reduction device 4 reads a frequency equal to or higher than the predetermined control band from storage unit 11, and sets the frequency as the cut-off frequency $f_{LF}(n)$ in cut-off frequency determination step 547*c*. On the other hand, if it is determined in control step 505 that the signal level $L_x(n)$ is small, active noise reduction device 4 reads a lower frequency from storage unit 11, and sets the frequency as the cut-off frequency $f_{LF}(n)$ in cut-off frequency determination step 547*c*. Alternatively, active noise reduction device 4 may calculate the cut-off frequency $f_{LF}(n)$ by multiplying the frequency prescribed as the upper limit of the control band by the level adjustment coefficient $\alpha(n)$ in cut-off frequency determination step 547*c*, for example.

Figure 11:
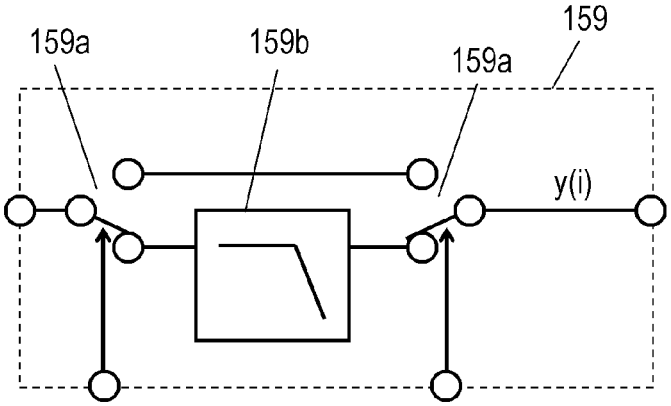
FIG. 11 is a block diagram of the cancel signal generation block of the active noise reduction device of the sixth example according to Embodiment 1.

FIG. 11 is a block diagram of adjustment unit 159 in cancel signal generation block 155 of the sixth example according to Embodiment 1. Cancel signal generation block 155 of the sixth example includes ADF 5 and adjustment unit 159.

Adjustment unit 159 in this example receives the control signal that is output from control block 8 or control block 128, and adjusts the output of the cancel signal y(i) based on the control signal. For this purpose, adjustment unit 159 includes processing selection unit 159*a* and LPF 159*b*.

For example, adjustment unit 159 is provided between ADF 5 and output terminal 42. In this case, if control block 8 or control block 128 determines that the signal level $L_x(n)$ is small, processing selection unit 159*a* supplies the cancel signal y(n) that is output from ADF 5 to LPF 159*b*. Thus, the cancel signal y(n) is output to output terminal 42 through LPF 159*b*. Meanwhile, if control block 8 or control block 128 determines that the signal level $L_x(n)$ is large, processing selection unit 159*a* supplies the cancel signal y(n) that is output from ADF 5 to output terminal 42 as it is.

As described above, processing selection unit 159*a* selects one of the output signal of ADF 5 and the output signal of LPF 159*b*, and supplies the selected output signal to output terminal 42. Here, the cut-off frequency $f_{LF}$ of LPF 159*b* is set equal to or lower than the cut-off frequency flu of HPF 120*a* in level detection unit 120. In this case, if control block 8 or control block 128 determines that the signal level $L_x(i)$ is small, control block 8 or control block 128 outputs the control signal for selecting the output signal of LPF 159*b* out of ADF 5 and LPF 159*b* to adjustment unit 159.

All or part of adjustment unit 159 may be provided inside the signal-processing device and outside cancel signal generation block 155. For example, all or part of adjustment unit 159 may be provided between cancel signal generation block 155 and output terminal 42. Alternatively, all or part of adjustment unit 159 can be included in output terminal 42. Moreover, all or part of adjustment unit 159 may be provided outside the signal-processing device, and for example, can be included in cancel sound source 2.

Adjustment unit 159 may be provided between ADF 5 and reference signal input terminal 41. In this case, if control block 8 or control block 128 determines that the signal level $L_x(n)$ is large, processing selection unit 159*a* supplies the reference signal x(n) to ADF 5 as it is. That is, if control block 8 or control block 128 determines that the signal level $L_x(n)$ is small, processing selection unit 159*a* makes a selection to supply the reference signal x(n) to LPF 159*b*. This configuration causes the reference signal x(n) to be output to ADF 5 through LPF 159*b*. That is, processing selection unit 159*a* selects whether to input the reference signal x(n) from reference signal input terminal 41 to ADF 5 directly, or to input the reference signal x(n) to ADF 5 through LPF 159*b*.

The aforementioned configuration causes the reference signal x(i) having a frequency equal to or higher than the cut-off frequency $f_{LF}$ of LPF 159*b* to be attenuated. As a result, the level of the noise sound contained in cancel sound N1 can be decreased if noise N0 is small, the noise sound resulting from the reference signal noise $x_z(i)$. Furthermore, active noise reduction device 4 of this example, which outputs ordinary cancel sound N1 in the frequency band equal to or lower than the cut-off frequency $f_{LF}$, can obtain a good noise reduction effect continuously.

Although it is assumed that the cut-off frequency $f_{LF}$ of LPF 159*b* is fixed, this example is not limited to the fixed frequency. The cut-off frequency $f_{LF}(i)$ of LPF 159*b* may be changed, for example, depending on magnitude of the signal level $L_x(i)$ of the reference signal x(i). In this case, LPF 159*b* can be adjusted so that the signal level of the cancel signal y(i) becomes smaller only in the band where the reference signal noise $x_z(i)$ exceeds the noise component signal $x_N(i)$. Therefore, active noise reduction device 4 of this example can effectively reduce the noise of the suitable band in accordance with the magnitude of the signal level $L_x(i)$ of the reference signal x(i).

Processing selection unit 159*a* of this example may be, for example, made of a selector switch. In this case, processing selection unit 159*a* is switched based on the determination result of control block 8 or control block 128. Although processing selection unit 159*a* is provided on both sides of input and output of LPF 159*b*, processing selection unit 159*a* may be provided at least on one of the input side and the output side.

Figure 10B:
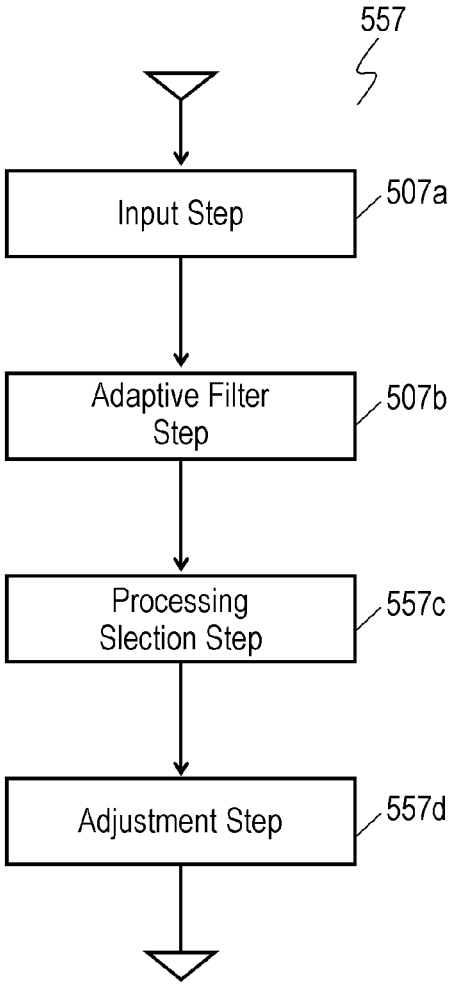
FIG. 10B is another flow chart of the cancel signal generation block of the active noise reduction device of the fifth example according to Embodiment 1.

Cancel signal generation step 557 of this example will be described with reference to FIG. 10B. Cancel signal generation step 557 can be replaced with cancel signal generation step 507 in FIG. 4. In FIG. 10B, cancel signal generation step 557 includes input step 507*a* and adaptive filter step 507*b*, and may additionally include processing selection step 557*c* and adjustment step 557*d*.

If the LPF is configured to reduce a component having a frequency equal to or higher than the cut-off frequency $f_{LF}$ from the cancel signal y(n) to output the obtained signal to output terminal 42, adjustment step 557*d* is provided after adaptive filter step 507*b*. In adjustment step 557*d*, active noise reduction device 4 outputs, to output terminal 42, the signal obtained by the LPF reducing the component having the frequency equal to or higher than the cut-off frequency $f_{LF}$ from the cancel signal y(n).

In this case, in processing selection step 557*c*, active noise reduction device 4 switches whether to output the cancel signal y(n) calculated in adaptive filter step 507*b* directly to output terminal 42, or to output the cancel signal y(n) to output terminal 42 through adjustment step 557*d*.

In adaptive filter step 507*b*, if the signal obtained by the LPF reducing the component having the frequency equal to or higher than the cut-off frequency $f_{LF}$ from the reference signal x(i) is used, adjustment step 557*d* is provided between input step 507*a* and adaptive filter step 507*b*. In adjustment step 557*d*, the signal obtained by the LPF reducing the component having the frequency equal to or higher than the cut-off frequency $f_{LF}$ from the reference signal x(i) is output to adaptive filter step 507*b*.

In this case, in processing selection step 557*c*, active noise reduction device 4 switches whether to use the reference signal x(i) that is directly output from reference signal input terminal 41 in adaptive filter step 507*b*, or to use the reference signal x(i) that is output in adjustment step 557*d*, depending on the determination result in control step 505.

The component having the frequency equal to or higher than the cut-off frequency fun may be further reduced from the cancel signal y(i) by the LPF after adaptive filter step 507*b*. According to such a configuration, if it is determined in control step 505 that the signal level $L_x(n)$ is small, it is determined that at least one of adjustment step 557*d* before and after adaptive filter step 507*b* is executed. Processing selection step 557*c* is provided after input step 507*a* and before adjustment step 557*d*.

Cancel signal generation step 557 may further include the cut-off frequency determination step 547*c* provided between input step 507*a* and adjustment step 557*d*. In this case, in the cut-off frequency determination step 547*c*, the cut-off frequency $f_{LF}(i)$ of the LPF is determined based on the control signal of control step 505.

Figure 12:
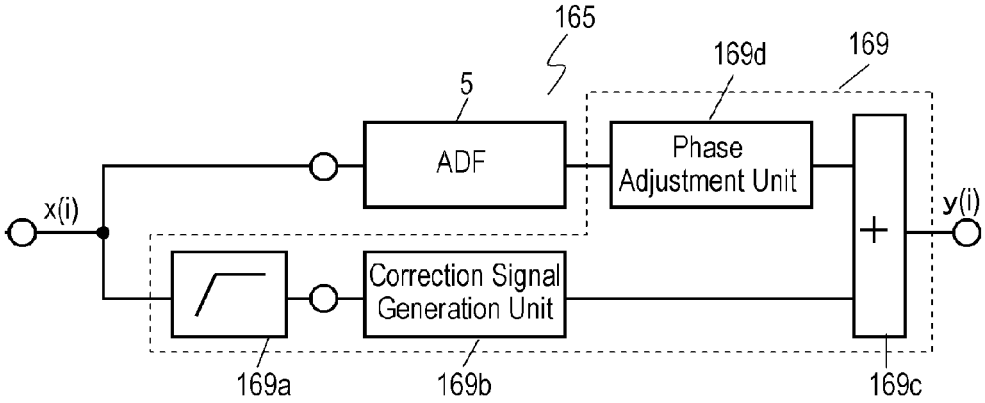
FIG. 12 is a block diagram of the cancel signal generation block of the active noise reduction device of the seventh example according to Embodiment 1.

FIG. 12 is a block diagram of cancel signal generation block 165 of the seventh example according to the present exemplary embodiment. Cancel signal generation block 165 of the seventh example illustrated in FIG. 2 and FIG. 12 includes ADF 5 and adjustment unit 169. Adjustment unit 169 includes HPF 169*a*, correction signal generation unit 169*b*, and summing unit 169*c*.

HPF 169*a* receives the reference signal x(i), and outputs the high-frequency component signal $x_{HF}(n)$ that is a component having a frequency equal to or higher than the frequency $f_{HF}$ out of the reference signals x(n), . . . , $x(n-\gamma_{HF})$ at the past from the current time by $\gamma_{HF}$ steps. If cancel signal generation block 165 is formed in combination with control block 128, control block 128 supplies the high-frequency component signal $x_{HF}(i)$ to correction signal generation unit 169*b*, so that HPF 169*a* can be omitted.

Correction signal generation unit 169*b* receives the high-frequency component signal $x_{HF}(i)$, and generates a correction signal z(n), as expressed by Formula 14.

$$z(n) = -\sum_{k=0}^{N-1} w(k, n) \cdot x_{HF}(n-k) \quad \text{(Formula 14)}$$

If control block 8 or control block 128 determines that the level of the signal level $L_x(n)$ is small, summing unit 169*c* outputs a signal obtained by adding the cancel signal y(n) generated by ADF 5 to the correction signal z(n) to output terminal 42.

In the configuration in which summing unit 169*c* has only a function of adding the cancel signal y(i) to the correction signal z(i), if control block 8 or control block 128 determines that the signal level $L_x(i)$ is large, correction signal generation unit 169*b* outputs 0.

Summing unit 169*c* may include a switch and an adder. In this case, the correction signal z(i) is input into the adder through the switch. If control block 8 or control block 128 determines that the signal level $L_x(n)$ is large, the switch of summing unit 169*c* is turned off. As a result, supply of the correction signal z(n) to the adder is stopped.

Moreover, summing unit 169*c* can also be configured to use the level adjustment coefficient α(i) to add the correction signal z(i) to the cancel signal y(i), as expressed by Formula 15. In this case, adjustment unit 169 also receives the level adjustment coefficient α(i). If control block 8 or control block 128 determines that the signal level $L_x(n)$ is large, α(n)=0 is output. If control block 8 or control block 128 determines that the signal level $L_x(n)$ is small, α(n)=1 is output.

$$y(n)=y(n)+\alpha(n)\cdot z(n) \quad \text{(Formula 15)}$$

As described above, summing of the cancel signal y(i) and the correction signal z(i) can cancel the component that is based on the high-frequency component signal $x_{HF}(i)$ contained in the cancel signal y(i) if noise N0 is small. Therefore, this allows decrease of the level of the noise sound resulting from the reference signal noise $x_z(i)$ contained in cancel sound N1.

Correction signal z(i) has a phase shift with respect to the cancel signal y(i). This phase shift results from HPF 169*a* or HPF 120*a*. In order to deal with this phase shift, adjustment unit 169 may include phase adjustment unit 169*d*. Phase adjustment unit 169*d* corrects the phase shift between the cancel signal y(i) and the correction signal z(i). For this purpose, phase adjustment unit 169*d* is provided, for example, between ADF 5 and summing unit 169*c*. Such a configuration allows more precise decrease of the level of the noise sound resulting from the reference signal noise $x_z(i)$.

Figure 13:
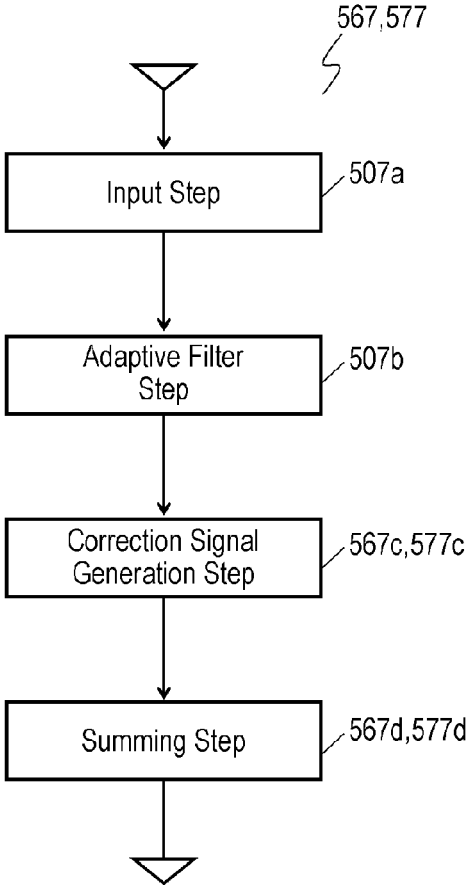
FIG. 13 is a flow chart of the operation of the active noise reduction device of the seventh example according to Embodiment 1.

FIG. 13 is a control flow chart of cancel signal generation block 165 of the seventh example according to Embodiment 1. As illustrated in FIG. 13, cancel signal generation step 567 of this example includes input step 507*a* and adaptive filter step 507*b*. Cancel signal generation step 567 can be replaced with cancel signal generation step 507 in FIG. 4.

Cancel signal generation step 567 further includes correction signal generation step 567*c* and summing step 567*d*. In this case, summing step 567*d* is provided after adaptive filter step 507*b*. In correction signal generation step 567*c*, the high-frequency component signal $x_{HF}(i)$ having a frequency equal to or higher than the frequency $f_{HF}$ is extracted from the reference signal x(i) by using the HPF or the BPF that has the cut-off frequency $f_{HF}$. For this purpose, correction signal generation step 567*c* is provided between input step 507*a* and summing step 567*d*. If the high-frequency component signal $x_{HF}(i)$ is extracted in control step 505, the high-frequency component signal $x_{HF}(i)$ may be read in input step 507*a*. In correction signal generation step 567*c*, the correction signal z(n) is generated by Formula 14.

If it is determined in control step 505 that the signal level $L_x(n)$ is small, the correction signal z(n) is added to the cancel signal y(n) in summing step 567*d*. In summing step 567*d*, the correction signal z(n) is added to the cancel signal y(n), for example, by using the level adjustment coefficient α(n), as expressed by Formula 15. In this case, if it is determined in control step 505 that the signal level $L_x(n)$ is large, α(n)=0 is output. If it is determined in control step 505 that the signal level $L_x(n)$ is small, α(n)=1 is output.

In addition, the phase of the cancel signal y(i) may be adjusted in correction signal generation step 567*c*. In this case, the cancel signal y(i) calculated in adaptive filter step 507*b* is also input in correction signal generation step 567*c*. Then, the phase shift between the cancel signal y(i) and the correction signal z(i) is corrected in correction signal generation step 567*c*. As a result, the cancel signal y(i) that has the phase aligned with the correction signal z(i) is input in summing step 567*d*.

Figure 14:
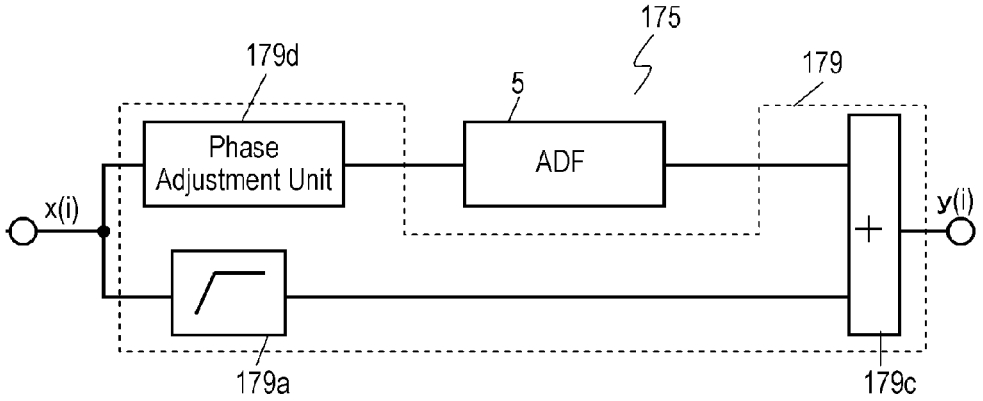
FIG. 14 is a block diagram of the cancel signal generation block of the active noise reduction device of the eighth example according to Embodiment 1.

FIG. 14 is a block diagram of cancel signal generation block 175 of the eighth example according to the present exemplary embodiment. Cancel signal generation block 175 of the eighth example illustrated in FIG. 2 and FIG. 14 includes ADF 5 and adjustment unit 179. Adjustment unit 179 includes HPF 179*a* and summing unit 179*c*. If cancel signal generation block 175 is configured in combination with control block 128, control block 128 may output the high-frequency component signal $x_{HF}(i)$ and input this signal into adjustment unit 179. In this case, HPF 179*a* can be omitted.

If control block 8 or control block 128 determines that the signal level $L_x(n)$ is small, summing unit 179*c* inverts the phase of the high-frequency component signal $x_{HF}(n)$ to generate the high-frequency component signal $(-x_{HF}(n))$. Furthermore, summing unit 179*c* adds the reference signal x(n) to the high-frequency component signal $(-x_{HF}(n))$.

Summing unit 179*c* may include a switch and an adder. Summing unit 179*c* may be configured so that the reference signal x(i) and the high-frequency component signal $x_{HF}(i)$ through the switch are input into the adder. In this case, if control block 8 or control block 128 determines that the signal level $L_x(n)$ is large, summing unit 179*c* turns off the switch to stop supply of the high-frequency component signal $x_{HF}(n)$ to the adder.

Summing unit 179*c* can also add the high-frequency component signal $x_{HF}(n)$ to the reference signal x(n) by using the level adjustment coefficient α(n), as expressed by Formula 16. In this case, control block 8 or control block 128 supplies the level adjustment coefficient α(n) also to adjustment unit 179. If control block 8 or control block 128 determines that the signal level $L_x(n)$ is large, α(n)=0 is output. If control block 8 or control block 128 determines that the signal level $L_x(n)$ is small, α(n)=−1 is output.

$$x(n)=x(n)+\alpha(n)\cdot x_{HF}(n) \quad \text{(Formula 16)}$$

As described above, summing unit 179*c* sums up the reference signal x(i) and the high-frequency component signal $(-x_{HF}(i))$, so that components based on the high-frequency component signal $x_{HF}(i)$ contained in the reference signal x(i) can be canceled if noise N0 is small. Therefore, this allows decrease of the level of the noise sound resulting from the reference signal noise $x_z(i)$ contained in cancel sound N1.

In addition, adjustment unit 179 may include phase adjustment unit 179*d*. In this case, phase adjustment unit 179*d* is provided, for example, between reference signal input terminal 41 and ADF 5. Phase adjustment unit 179*d* corrects the phase shift between the reference signal x(i) and the high-frequency component signal $x_{HF}(i)$. This configuration allows more precise decrease of the level of the noise sound resulting from the reference signal noise $x_z(i)$.

Cancel signal generation step 577 of this example illustrated in FIG. 13 includes input step 507*a* and adaptive filter step 507*b*. Cancel signal generation step 577 can be replaced with cancel signal generation step 507 in FIG. 4.

Cancel signal generation step 577 further includes correction signal generation step 577*c* and summing step 577*d*. In correction signal generation step 577*c*, active noise reduction device 4 extracts the high-frequency component signal $x_{HF}(i)$ having a frequency equal to or higher than the frequency $f_{HF}$ from the reference signal x(i) by using the HPF or BPF having the cut-off frequency $f_{HF}$. For this purpose, correction signal generation step 577*c* is provided between input step 507*a* and summing step 577*d*. If the high-frequency component signal $x_{HF}(i)$ is extracted in control step 505, this high-frequency component signal $x_{HF}(i)$ may be read in input step 507*a*.

If it is determined in control step 505 that the signal level $L_x(n)$ is small, the high-frequency component signal $x_{HF}(n)$ is subtracted from the reference signal x(n) in summing step 577*d*. For this purpose, in summing step 577*d*, the level adjustment coefficient α(n) is used to add the high-frequency component signal $x_{HF}(n)$ to the reference signal x(n), for example, as expressed by Formula 16. In this case, if it is determined in control step 505 that the signal level $L_x(n)$ is large, α(n)=0 is output. If it is determined that the signal level $L_x(n)$ is small in control step 505, α(n)=−1 is output.

In addition, the phase of the reference signal x(n) may be adjusted in correction signal generation step 577*c*. In this case, the phase shift between the reference signal x(n) and the high-frequency component signal $x_{HF}(n)$ is corrected in correction signal generation step 577*c*. As a result, the reference signal x(n) that has the phase aligned with the high-frequency component signal $x_{HF}(n)$ is input into summing step 577*d*.

In each example according to Embodiment 1, the cancel signal y(i), the reference signal x(i), or the filter coefficient W(i) is corrected. Accordingly, the simulated acoustic transfer characteristic data Cˆ used in Chat 6 illustrated in FIG. 2 will vary from a preset value.

Accordingly, Chat 6 according to Embodiment 1 may be configured to correct the simulated acoustic transfer characteristic data C^ in accordance with the correction performed by the cancel signal generation block of each example, if control block 8 or control block 128 determines that the signal level $L_x(n)$ is small. This configuration allows control of degradation in the noise reduction effect, divergence of the filter coefficient W(i), and the like. As a result, the simulated acoustic transfer characteristic data C^ that simulates characteristics of the accurate signal path can be used even if cancel sound N1 is corrected. Therefore, active noise reduction device 4 capable of reducing noise N0 more precisely can be provided.

Exemplary Embodiment 2

Figure 15:
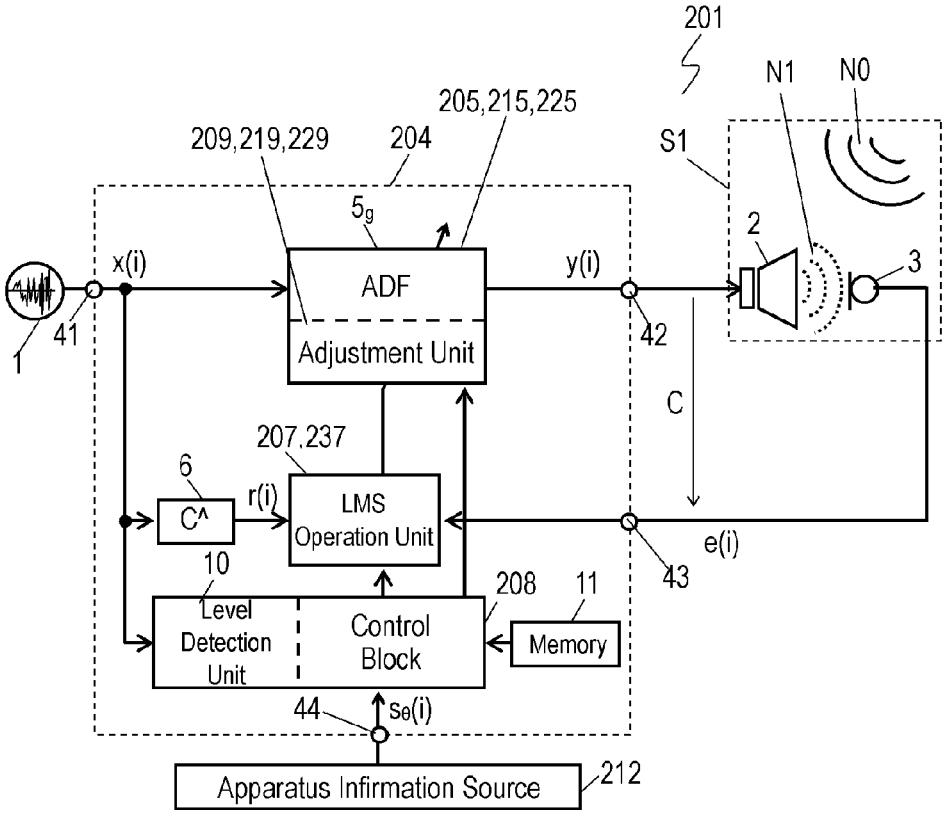
FIG. 15 is a block diagram of an active noise reduction system using an active noise reduction device according to Exemplary Embodiment 2 of the present invention.
Figure 16:
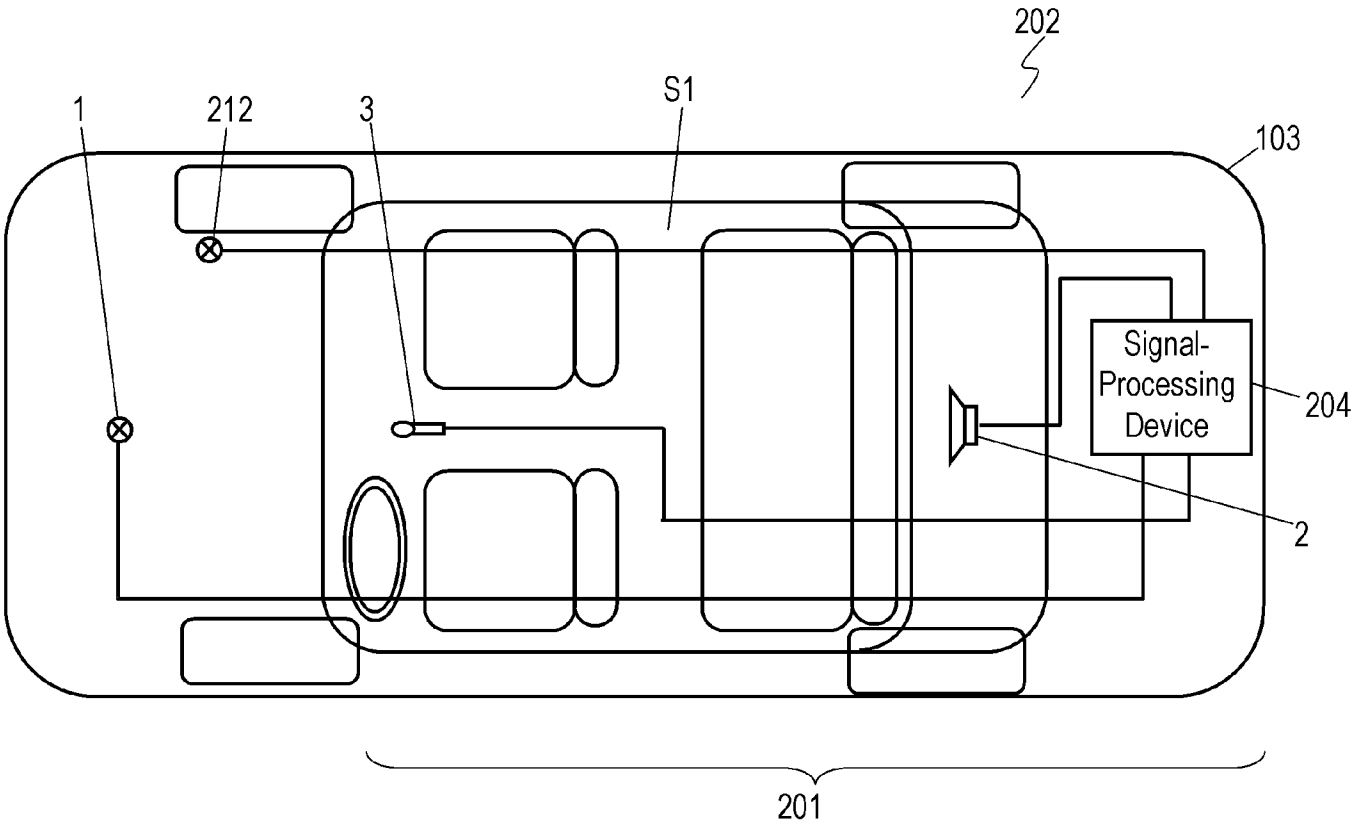
FIG. 16 is a schematic diagram of a mobile unit apparatus using the active noise reduction device according to Embodiment 2.
Figure 17:
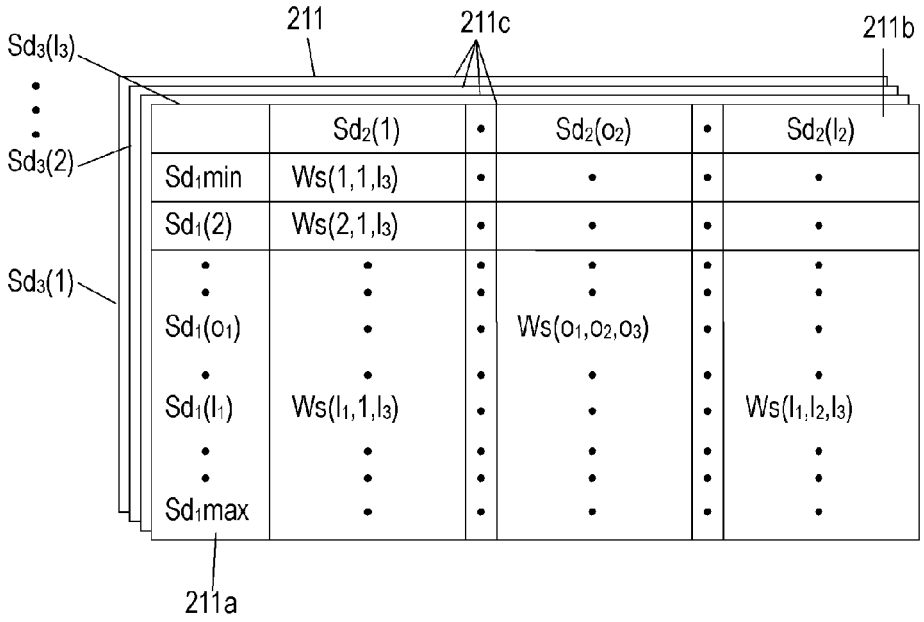
FIG. 17 is a diagram illustrating a correspondence table stored in the active noise reduction device according to Embodiment 2.

FIG. 15 is a block diagram of active noise reduction system 201 using active noise reduction device 204 according to Exemplary Embodiment 2 of the present invention. FIG. 16 is a schematic diagram of a mobile unit apparatus using active noise reduction device 204 according to Embodiment 2. FIG. 17 is a diagram illustrating correspondence table 211 stored in storage unit 11 of active noise reduction device 204 according to Embodiment 2. In FIG. 15 and FIG. 16, components identical to components of FIG. 1 and FIG. 2 are denoted by the same reference numerals.

Control block 208 of active noise reduction system 201 according to the present exemplary embodiment detects one or more pieces of apparatus information $s_\theta(i)$ related to noise N0 other than a reference signal x(i). Active noise reduction system 201 then reduces noise N0 that varies in accordance with a change in the apparatus information $s_\theta(i)$. The apparatus information $s_\theta(i)$ has a subscript 0 that represents a number of pieces of the apparatus information.

Active noise reduction system 201 includes apparatus information source 212. Apparatus information source 212 outputs the apparatus information $s_\theta(i)$ related to noise N0. For example, apparatus information source 212 may include various detectors for detecting an operating condition of automobile 202, an input device with which an operator who operates active noise reduction system 201 directly inputs the apparatus information $s_\theta(i)$, and the like. Apparatus information source 212 is connected to apparatus information input terminal 44 of active noise reduction device 204, and supplies the detected apparatus information $s_\theta(i)$ to control block 208. Moreover, control block 208 is supplied with an output of level detection unit 10 of the present exemplary embodiment, and control block 208 can detect a signal level $L_x(i)$ of the reference signal x(i).

In a mobile unit like automobile 202, the apparatus information $s_\theta(i)$ that has a relation with noise N0 includes various types of information. Examples of the apparatus information $s_\theta(i)$ include information related to a running condition, information related to a tire, information regarding a road, information regarding a condition of automobile 202, and information regarding environment.

Examples of the information related to the running condition include velocity, acceleration, and engine speed of an automobile. Examples of the information related to a tire include tire pressure, a material of the tire, a tread pattern of the tire, a tread depth of the tire, the aspect ratio of the tire, and a temperature of the tire. Examples of the information related to a road include a road surface condition (degree of unevenness, or dry condition, wet condition, snow coverage condition, freezing condition, or a road surface frictional resistance value), and a surface temperature of the road. Examples of the information on the condition of automobile 202 include weight (including the weight of automobile 202 itself, weight of onboard persons, weight of onboard cargo, weight of gasoline), degree of opening of a window, and hardness of a suspension. Furthermore, examples of the information regarding environment include weather and temperature.

If automobile 202 passes through a railway crossing, noise N0 is generated by passage over a step, such as a railway track. In addition, in a place, such as a tunnel, a noise generated from the tire may be reflected by a tunnel wall surface and go into space S1 as a reflected sound. In addition to the above-described devices, a car navigation system or a smart phone mounted in automobile 202 may be used as apparatus information source 212. In this case, it is also possible to obtain information regarding approaching or information regarding passing through a railway crossing or a tunnel from these apparatuses as the apparatus information $s_\theta(i)$.

In addition, noise N0 changes with the tread pattern or the aspect ratio of the tire, elasticity of the suspension, and the like. For example, if the tire or the suspension is replaced, a characteristic of noise N0 changes compared with the characteristic before replacement of the tire or the suspension. However, it is difficult to detect such information with the detector attached to automobile 202. Therefore, the operator operates the input device to input such apparatus information $s_\theta(i)$ directly into active noise reduction device 204.

Correspondence table 211 illustrated in FIG. 17 is stored in storage unit 11. Correspondence table 211 stores a plurality of pieces of predetermined apparatus information data $Sd_\theta(l_\theta)$ corresponding to the apparatus information $s_\theta(i)$. Control block 208 then selects one or more pieces of apparatus information data $Sd_\theta(l_\theta)$ from correspondence table 211 as apparatus information data $Sd_\theta(j,i)$ based on each piece of the apparatus information $s_\theta(i)$. A number j of pieces of apparatus information data to select may differ for each number θ that represents a type of apparatus information.

LMS operation unit 207 according to the present exemplary embodiment generates two or more filter coefficients $W_j(n+1)$ and two or more pieces of filter coefficient data $WD_j(n)$, and stores the coefficients $W_j(n+1)$ and filter coefficient data $WD_j(n)$ in storage unit 11. LMS operation unit 207 according to the present exemplary embodiment generates three filter coefficients $W_j(n+1)$, (j=0, 1, 2) and filter coefficient data $WD_j(n)$.

The current filter coefficients $W_j(n)$ are each represented as a vector matrix with N rows and one column, composed of N filter coefficients $w_j(k,n)$, (k=0, 1, . . . , N−1), as expressed by Formula 17.

$$W_j(n)=[w_j(0,n),w_j(1,n), \ldots ,w_j(N-1,n)]^T \quad \text{(Formula 17)}$$

The filter coefficient data $WD_j(n)$ is represented by N filter coefficients $wd_j$ (k,n) as expressed by Formula 18.

$$WD_j(n)=[wd_j(0,n),wd_j(1,n), \ldots ,wd_j(N-1,n)]^T \quad \text{(Formula 18)}$$

LMS operation unit 207 calculates each of the next filter coefficients $W_j(n+1)$ by using a current error signal e(n), a filtered reference signal R(n), a step size parameter μ, and the filter coefficient data $WD_j(n)$, as expressed by Formula 19.

$$W_j(n+1)=WD_j(n)-\mu\cdot e(n)\cdot R(n) \quad \text{(Formula 19)}$$

In addition to the current error signal e(n), the filtered reference signal R(n), the step size parameter μ, and the filter coefficient data $WD_j(n)$, each of correction values $b_j(n)$ generated by control block 208 is used to calculate the next filter coefficient data $WD_j(n+1)$, as expressed by Formula 20.

$$WD_j(n+1)=WD_j(n)-b_j(n)\cdot\mu\cdot e(n)\cdot R(n) \quad \text{(Formula 20)}$$

Cancel signal generation block 205 includes ADF 5 and adjustment unit 209. Adjustment unit 209 receives the current filter coefficients $W_j(n)$, contribution degrees $a_j(n)$, and a level adjustment coefficient $\alpha(n)$. The current filter coefficient $W_j(n)$ is calculated last time by LMS operation unit 207. The contribution degree $a_j(n)$ is calculated by control block 208. In the present exemplary embodiment, the number of pieces of first apparatus information data $Sd_1(j,i)$ to select, the number of filter coefficients $W_j(i)$, the number of contribution degrees $a_j(i)$, and the number of correction values $b_j(i)$ are identical to one another. All of these numbers mentioned here are three (j=0, 1, 2), but the numbers are not limited to three. Adjustment unit 209 adds (sums up) the filter coefficient $W_j(n)$ based on the contribution degree $a_j(n)$ to calculate the filter coefficient W(n) used by ADF 5 in the current step, as expressed by Formula 21.

$$W(n) = \alpha(n)\sum_{j=0}^{2} a_j(n)\cdot W_j(n) \quad \text{(Formula 21)}$$

where $$\sum_{j=0}^{2} a_j(n) = 1$$

As expressed by Formula 21, the sum of contribution degrees $a_j(n)$ is 1. A value of each of the correction values $b_j(n)$ that is input into LMS operation unit 207 and a value of each of the contribution degrees $a_j(n)$ that is input into the adjustment unit are equal to each other. As a result, the value of the total step size parameter from the (n−1)-th step cancel signal y(n−1) to the n-th step cancel signal y(n) will become the step size parameter μ. Therefore, the value of the step size parameter μ can be constant without depending on the correction values $b_j(i)$ or the values of the contribution degrees $a_j(i)$, and thus allowing stable adaptive control.

Adjustment unit 209 of this example obtains the filter coefficients $W_j(i)$ by performing operations (multiplication and addition). However, adjustment unit 209 is not limited to this example. For example, adjustment unit 209 may use a variable gain amplifier for amplifying the filter coefficients $W_j(i)$ in accordance with the contribution degrees $a_j(i)$ and the level adjustment coefficient α(i) in place of multiplication. In this case, a gain of the variable gain amplifier is adjusted to be equal to a value obtained by multiplying the contribution degree $a_j(i)$ by the level adjustment coefficient α(i). A synthesis unit for synthesizing the filter coefficients $W_j(i)$ may be used in place of addition.

Control block 208 selects two or more pieces of apparatus information data $Sd_\theta(j,i)$ corresponding to the apparatus information $s_\theta(i)$ from correspondence table sheet 211*c* in correspondence table 211. Moreover, control block 208 generates the contribution degrees $a_j(i)$ of the two filter coefficients $W_j(i)$ in the cancel signal y(i) based on the two or more pieces of selected apparatus information data $Sd_\theta(j,i)$ and the apparatus information $s_\theta(i)$, and outputs the contribution degrees $a_j(i)$ to adjustment unit 209. According to the above configuration, LMS operation unit 207 generates the next filter coefficients $W_j(n+1)$ based on the filter coefficient data $WD_j(n)$. Adjustment unit 209 calculates the filter coefficient W(n+1) based on the filter coefficients $W_j(n+1)$. Since the current filter coefficients $W_j(n)$ are input into adjustment unit 209, adjustment unit 209 adjusts a contribution of the current filter coefficients $W_j(n)$ in the cancel signal y(n) based on the contribution degrees $a_j(n)$.

Accordingly, in ADF 5, the filter coefficients $W_j(i)$ calculated by LMS operation unit 207 are updated to the filter coefficients W(i) according to the contribution degrees $a_j(i)$ or correction values $b_j(i)$ calculated by control block 208. This updating is performed every sampling period $T_s$. That is, cancel signal generation block 205 calculates the filter coefficient W(i) in accordance with the contribution degrees $a_j(i)$. As a result, cancel signal generation block 205 outputs the cancel signal y(i) in accordance with the contribution adjusted by adjustment unit 209.

According to such a configuration, the filter coefficient W(i) is determined in accordance with the filter coefficients $W_j(i)$ and the contribution degrees $a_j(i)$. In other words, cancel signal generation block 205 outputs the cancel signal y(i) by using the filter coefficient W(i) that is adjusted in accordance with the contribution degrees $a_j(i)$, as expressed by Formula 22.

$$y(n)=W^T(n)X(n) \quad \text{(Formula 22)}$$

As a result, ADF 5 can continue adaptive control in a state where the contribution of the filter coefficients $W_j(i)$ in the cancel signal y(i) is adjusted depending on the contribution degrees $a_j(i)$. Consequently, cancel signal generation block 205 can generate the cancel signal y(i) suitable for canceling noise N0 at a position of error signal source 3. Cancel sound source 2 emits cancel sound N1 corresponding to the cancel signal y(i) into space S1, so that noise N0 can be reduced in space S1.

According to the above configuration, cancel signal generation block 205 uses the contribution degrees $a_j(i)$ determined based on the apparatus information $s_\theta(i)$ and the selected two or more pieces of apparatus information data $Sd_\theta(j,i)$ to adjust the contribution of the filter coefficients $W_j(i)$ in the cancel signal y(i). Accordingly, active noise reduction device 204 capable of reducing noise N0 well can be obtained even if the apparatus information $s_\theta(i)$ changes. Although it is assumed that the number of pieces of apparatus information data $Sd_\theta(j,i)$ to select, the number of filter coefficients $W_j(i)$, and the number of contribution degrees $a_j(i)$ are identical to one another, these numbers may differ from one another.

If the apparatus information $s_\theta(i)$ changes, control block 208 changes the contribution degrees $a_j(i)$, so that cancel signal generation block 205 can quickly change the cancel signal y(i) to an optimal value. As a result, cancel signal generation block 205 can quickly change the cancel signal y(i) to the optimal value, and thus the error signal e(i) also decreases quickly. Consequently, the filter coefficient W(i) of cancel signal generation block 205 is also stabilized quickly, and thus active noise reduction device 204 capable of quickly reducing noise N0 can be obtained.

Furthermore, control block 208 determines the contribution degrees $a_j(i)$ based on the apparatus information $s_\theta(i)$ and two or more pieces of the selected apparatus information data $Sd_\theta(j,i)$, and cancel signal generation block 205 outputs the cancel signal y(i) in accordance with the determined contribution degrees $a_j(i)$. Such a configuration eliminates the need for preparing many pieces of apparatus information data $Sd_\theta(l_\theta)$ in advance in storage unit 11. Accordingly, the number $l_\theta$ of pieces of apparatus information data $Sd_\theta(l_\theta)$ stored in storage unit 11 can be decreased, and thus a memory capacity of storage unit 11 can be decreased. As a result, active noise reduction device 204 can be small and low-priced.

Automobile 202 has many pieces of apparatus information $s_\theta(i)$. An example of using three pieces of apparatus information $s_\theta(i)$, ($\theta$=1, 2, 3) will be described here for convenience. As the first apparatus information $s_1(i)$, information that exerts largest influence on noise N0 is selected from the apparatus information $s_\theta(i)$.

Correspondence table 211 includes the plurality of correspondence table sheets 211*c* that correspond to third apparatus information data $Sd_3(l_3)$ corresponding to third apparatus information $s_3(i)$. Each of the plurality of correspondence table sheets 211*c* stores first apparatus information data group 211*a* corresponding to the first apparatus information $s_1(i)$ and second apparatus information data group 211*b* corresponding to second apparatus information $s_2(i)$, out of the plurality of pieces of apparatus information $s_\theta(i)$.

First apparatus information data group 211*a* includes the plurality of pieces of first apparatus information data $Sd_1(l_1)$. In contrast, second apparatus information data group 211*b* includes a plurality of pieces of second apparatus information data $Sd_2(l_2)$. Consequently, each correspondence table sheet 211*c* is a table having a vertical axis of one of first apparatus information data group 211*a* and second apparatus information data group 211*b*, the table having a horizontal axis of the other one. Furthermore, each correspondence table sheet 211*c* stores a predetermined value $Ws(l_1,l_2,l_3)$ of the filter coefficient corresponding to each of the first apparatus information data $Sd_1(l_1)$ and the second apparatus information data $Sd_2(l_2)$. Thus, control block 208 according to the present exemplary embodiment reads the predetermined value $Ws(l_1,l_2,l_3)$ corresponding to the selected first apparatus information data $Sd_1(l_1)$, the second apparatus information data $Sd_2(l_2)$, and the third apparatus information data $Sd_3(l_3)$, out of correspondence table 211. Therefore, control block 208, which does not need correction calculation for determining the predetermined value Ws, can perform processing quickly.

The following describes an example of correspondence table 211 in which first apparatus information data group 211*a* is the vertical axis and second apparatus information data group 211*b* is the horizontal axis. Although the vertical axis is first apparatus information data group 211*a* in the present exemplary embodiment, the vertical axis may be second apparatus information data group 211*b* or a third apparatus information data group. Although the horizontal axis is second apparatus information data group 211*b* in the present exemplary embodiment, the horizontal axis may be first apparatus information data group 211*a* or the third apparatus information data group. Furthermore, although the third apparatus information data is set for each sheet in the present exemplary embodiment, the first apparatus information data or the second apparatus information data may be set for each sheet.

The predetermined value $Ws(o_1,o_2,o_3)$ in correspondence table 211 corresponds to $o_3$-th correspondence table sheet 211*c* corresponding to the third apparatus information data $Sd_3(l_3)$. Furthermore, the predetermined value $Ws(o_1,o_2,o_3)$ corresponds to the first apparatus information data $Sd_1(o_1)$ and second apparatus information data $Sd_2(o_2)$ in $o_3$-th correspondence table sheet 211*c*. Here, the first apparatus information data $Sd_1(o_1)$ is $o_1$-th data of first apparatus information data group 211*a*, whereas the second apparatus information data $Sd_2(o_2)$ is $o_2$-th data of second apparatus information data group 211*b*.

Next, an operation of control block 208 will be described in more detail. Control block 208 selects correspondence table sheet 211*c* of the third apparatus information data $Sd_3(l_3)$ corresponding to the third apparatus information $s_3(i)$ out of correspondence table 211. Control block 208 selects a column of the second apparatus information data $Sd_2(l_2)$ corresponding to the second apparatus information $s_2(i)$ out of selected correspondence table sheet 211*c* as the column for selecting the predetermined value $Ws(l_1,l_2,l_3)$ of the filter coefficient corresponding to the apparatus information data $Sd_{123}(l_1,l_2,l_3)$. Furthermore, control block 208 selects two or more pieces of first apparatus information data $Sd_1(l_1)$ corresponding to the first apparatus information $s_1(i)$ out of first apparatus information data group 211*a*.

For example, an example will be described in which the first apparatus information $s_1(i)$ is equal to or greater than the first apparatus information data $Sd_1(o_1)$ and is less than the first apparatus information data $Sd_1(o_1+p_1)$, the second apparatus information $s_2(i)$ is the second apparatus information data $Sd_2(o_2)$, and the third apparatus information $s_3(i)$ is the third apparatus information data $Sd_3(o_3)$. Here, the first apparatus information data $Sd_1(o_1+p_1)$ is the $(o_1+p_1)$-th data of first apparatus information data group 211*a*.

In this case, control block 208 selects at least two of the first apparatus information data $Sd_1(o_1)$ and the first apparatus information data $Sd_1(o_1+p_1)$. Control block 208 then calculates the contribution degrees $a_j(i)$ as expressed by Formula 23. That is, the contribution degrees $a_j(i)$ are calculated from any two pieces of first apparatus information data $Sd_1(j,i)$ out of the selected two or more pieces of first apparatus information data $Sd_1(j,i)$, and the first apparatus information $s_1(i)$.

$$\begin{aligned} a_0(i) &= b_0(i) \\ &= \frac{Sd_1(1,i) - s_1(i)}{Sd_1(1,i) - Sd_1(0,i)} \\ &= \frac{Sd_1(o_1+p_1) - s_1(i)}{Sd_1(o_1+p_1) - Sd_1(o_1)} \end{aligned} \qquad \text{(Formula 23)}$$

$$\begin{aligned} a_1(i) &= b_1(i) \\ &= \frac{s_1(i) - Sd_1(0,i)}{Sd_1(1,i) - Sd_1(0,i)} \\ &= \frac{s_1(i) - Sd_1(o_1)}{Sd_1(o_1+p_1) - Sd_1(o_1)} \\ &= 1 - a_0(i) \end{aligned}$$

In the present exemplary embodiment, although control block 208 calculates the contribution degrees $a_j(i)$ with two pieces of the first apparatus information data $Sd_1(j,i)$, control block 208 may calculate the contribution degrees $a_j(i)$ with the second apparatus information $s_2(i)$ and two pieces of second apparatus information data $Sd_2(j,i)$. Alternatively, control block 208 may calculate the contribution degrees $a_j(i)$ with the third apparatus information $s_3(i)$ and two pieces of the third apparatus information data $Sd_3$ (j,i).

If control block 208 selects three pieces of the first apparatus information data $Sd_1(j,i)$, control block 208 selects the first apparatus information data $Sd_1(o_1+p_1+q_1)$ or the first apparatus information data $Sd_1(o_1-p_1)$. Control block 208 then sets the contribution degrees $a_j(i)$ of the filter coefficients $W_j(i)$ corresponding to this filter coefficient at 0. That is, in this example, control block 208 sets the contribution degrees $a_j(i)$ other than two pieces of the apparatus information data $Sd_1(j,i)$ corresponding to the first apparatus information $s_1(i)$ at 0.

The pieces of first apparatus information data $Sd_1(l_1)$ adjacent to each other are arranged at regular intervals. In addition, the pieces of second apparatus information data $Sd_2(l_2)$ adjacent to each other are also arranged at regular intervals, and the pieces of third apparatus information data $Sd_3(l_3)$ adjacent to each other are also arranged at regular intervals. However, the pieces of apparatus information data adjacent to each other are not limited to be arranged at regular intervals. For example, the pieces of apparatus information data adjacent to each other may be arranged at suitably variable intervals, in consideration of the characteristic of noise N0 or the like. Note that, apparatus information representing a difference in a condition, for example opening and closing of a window, is set as apparatus information other than the first apparatus information.

Next, the operation if the second apparatus information $s_2(i)$ or the third apparatus information $s_3(i)$ changes will be described. A case where the first apparatus information $s_1(n)$ is between the first apparatus information data $Sd_1(o_1)$ and the first apparatus information data $Sd_1(o_1+p_1)$ illustrated in FIG. 17 will be described. On detection that the second apparatus information $s_2(n-1)$ changes to the second apparatus information $s_2(n)$, control block 208 illustrated in FIG. 15 replaces the current filter coefficient data $WD_j(n)$ with the predetermined value $Ws(o_1,l_2,l_3)$ corresponding to the apparatus information data $Sd_{123}(o_1,l_2,l_3,n)$, or with the predetermined value $Ws(o_1+p_1,l_2,l_3)$ corresponding to the apparatus information data $Sd_{123}(o_1+p_1,l_2,l_3,n)$.

In addition, on detection that the third apparatus information $s_3(n-1)$ changes to the third apparatus information $s_3(n)$, control block 208 replaces the current filter coefficient data $WD_j(n)$ with the predetermined value $Ws(o_1,l_2,l_3)$ corresponding to the apparatus information data $Sd_{123}(o_1,l_2,l_3,n)$, or with the predetermined value $Ws(o_1+p_1,l_2,l_3)$ corresponding to the apparatus information data $Sd_{123}(o_1+p_1,l_2,l_3,n)$.

In this example, however, only data having the smaller contribution degree $a_j(n)$ at present is changed among the filter coefficient data $WD_j(n)$. As a result, adaptive control is continuously applied to the filter coefficient $W_j(n)$ that has the larger contribution degree $a_j(n)$, so that noise N0 can be reduced precisely.

For example, the current filter coefficient data $WD_0(n)$ is rewritten into the predetermined value $Ws(o_1,o_2+p_2,o_3)$, if the contribution degree $a_1(n)$ is 0.3, the contribution degree $a_2(n)$ is 0.7, and the second apparatus information $s_2(i)$ changes from the second apparatus information data $Sd_2(o_2)$ to the second apparatus information data $Sd_2(o_2+p_2)$. If both the contribution degree $a_0(n)$ and the contribution degree $a_1(n)$ are 0.5, it is determined which filter coefficient to change depending on a tendency of change in the past contribution degrees. For example, if the contribution degree $a_1(i)$ tends to increase, the current filter coefficient data $WD—_0(n)$ is rewritten into the predetermined value $W_s(o_1, o_2+p_2,o_3)$.

Next, the following describes a case where it is detected that the first apparatus information $s_1(i)$ changes exceeding (over) certain first apparatus information data $Sd_1(j,n-1)$, and that the second apparatus information $s_2(i)$ or third apparatus information $s_3(i)$ also changes, the case having two filter coefficients $W_0(i)$ and $W_1(i)$. Note that, this does not restrict the case of having three or more filter coefficients $W_j(i)$, similarly to Embodiment 1. In such a case, the filter coefficients $W_j(i)$ are changed into the predetermined value $Ws(l_\theta)$ defined by the plurality of pieces of apparatus information $s_\theta(i)$.

For example, if the first apparatus information $s_1(n)$ changes exceeding (over) the first apparatus information data $Sd_1(o_1)$ to between the first apparatus information data $Sd_1(o_1)$ and $Sd_1(o_1+p_1)$, and if the second apparatus information $s_2(n)$ changes from the second apparatus information data $Sd_2(o_2)$ to the second apparatus information data $Sd_2(o_2+p_2)$, the current filter coefficient data $WD_0(n)$ corresponding to the apparatus information data $Sd_{123}(o_1-p_1,o_2,o_3)$ is rewritten into the predetermined value $Ws(o_1+p_1,o_2+p_2,o_3)$ corresponding to the apparatus information data $Sd_{123}(o_1+p_1,o_2+p_2,o_3)$. As a result, adaptive control is continuously applied to the filter coefficient $W_1(n)$ corresponding to the apparatus information data $Sd_{123}(o_1,o_2,o_3)$, so that noise N0 can be reduced precisely.

In this case, the apparatus information data $Sd_{123}(o_1,o_2+p_2,o_3)$ is selected in step $(n+\beta)$ that is $\beta$-th step from the current time, and at least the filter coefficient data $WD_1(n)$ corresponding to the apparatus information data $Sd_{123}(o_1,o_2,o_3)$ is rewritten into the predetermined value $Ws(o_1,o_2+p_2,o_3)$.

However, if the second apparatus information $s_2(i)$ or third apparatus information $s_3(i)$ changes drastically, the second apparatus information data $Sd_2(l_2)$ or third apparatus information data $Sd_3(l_3)$ after the change is selected. As a result, all pieces of the filter coefficient data $WD_j(n)$ are rewritten into two predetermined values $Ws(j,l_2,l_3)$ after the change corresponding to two pieces of apparatus information data $Sd_{123}(j,l_2,l_3)$ after the change. For this purpose, control block 208 detects the amount of change in the second apparatus information $s_2(i)$ and the third apparatus information $s_3(i)$. Control block 208 in this example determines that the second apparatus information $s_2(i)$ or third apparatus information $s_3(i)$ changes a lot if control block 208 determines that the amount of change in the second apparatus information $s_2(i)$ or third apparatus information $s_3(i)$ is larger than a prescribed value.

Next, the second apparatus information $s_2(i)$ is taken as an example for describing a case where the second apparatus information $s_2(i)$ (or the third apparatus information $s_3(i)$) after the change is not equal to any one of the second apparatus information data $Sd_2(l_2)$ (or the third apparatus information data $Sd_3(l_3)$). If the second apparatus information $s_2(i)$ changes, control block 208 outputs the correction value $b_{\theta j}(n)$ ($\theta=2$) after the change to storage unit 11. Control block 208 determines the correction value $b_{\theta j}(n)$ ($\theta=2$) based on the second apparatus information data $Sd_2(l_2,n-1)$ selected from the second apparatus information $s_2(n-1)$ before the change, the second apparatus information data $Sd_2(l_2,n)$ selected from the second apparatus information $s_2(n)$ after the change, and the second apparatus information $s_2(n)$. LMS operation unit 207 then corrects either one of the predetermined value $Ws(l_1,l_2,l_3)$ corresponding to the second apparatus information $s_2(n-1)$ before the change, and the predetermined value $Ws(l_1,l_2,l_3)$ corresponding to the second apparatus information $s_2(i)$ after the change, with the calculated correction value $b_{\theta j}(n)$. LMS operation unit 207 then outputs the corrected predetermined value as the filter coefficient data $WD_j(n)$. Although the example of the change in the second apparatus information $s_2(i)$ has been described here, this example is not restrictive. Also if the $\theta$-th apparatus information $s_\theta(i)$ changes, the same operation as described above generates the filter coefficient data $WD_j(n)$.

LMS operation unit 207 according to the present exemplary embodiment performs correction with the correction values $b_{\theta j}(n)$. However, adjustment unit 209 of cancel signal generation block 205 may perform the correction. Moreover, control block 208 can also perform the correction.

The correction values $b_{\theta j}(i)$ are correction values for correcting the filter coefficient data $WD_j(i)$ and the predetermined values $Ws(l_\theta)$ based on θ-th apparatus information data $Sd_\theta(l_\theta)$. That is, the number of filter coefficients $W_j(i)$ is related to the first apparatus information data $Sd_1(l_1)$. Therefore, the correction value $b_{\theta 1}(i)$ and correction value $b_{\theta 2}$ (i) based on other apparatus information data $Sd_\theta(l_\theta)$ can have identical values.

The aforementioned configuration can decrease the number of pieces of second apparatus information data $Sd_2(l_2)$ and third apparatus information data $Sd_3(l_3)$ to be stored in storage unit 11, and the number of predetermined values Ws(l). Accordingly, the increase in the memory size can be controlled. Furthermore, noise N0 can be reduced well regardless of the change in the second apparatus information $s_2(i)$ or the third apparatus information $s_3(i)$ even if the number of pieces of second apparatus information data $Sd_2(l_2)$ or third apparatus information data $Sd_3(l_3)$ is decreased.

Correspondence table 211 may be configured to store the correction values $b_{\theta j}(i)$ corresponding to the θ-th apparatus information data $Sd_\theta$ for the predetermined values Ws(l). Note that, the table of the correction values $b_{\theta j}(i)$ for the predetermined values Ws(l) stores the correction values $b_{\theta j}(l)$ corresponding to the apparatus information data $Sd_\theta j$ $(l_\theta)$ other than the first apparatus information data $Sd_1(l_1)$. In this case, control block 208 reads the correction values $b_{\theta j}(n)$ corresponding to the θ-th apparatus information $s_\theta(n)$ after the change from storage unit 11. LMS operation unit 207 then multiplies the predetermined values $Ws(l_1)$ by the correction values $b_{\theta j}(n)$, respectively. As a result, the predetermined values Ws(l) are corrected by the correction values $b_{\theta j}(n)$ to correspond to the second apparatus information $s_2(n)$ or the third apparatus information $s_3(n)$ after the change. Then, the corrected predetermined values Ws(l) will be the current filter coefficient data $WD_j(n)$.

Such a configuration allows calculation of the current filter coefficient data $WD_j(n)$ by a simple operation. Accordingly, the sampling period $T_s$ can be reduced. In addition, only the correction values $b_{\theta j}(l_\theta)$ need to be stored, and thus capacity of the storage area of storage unit 11 may be small.

LMS operation unit 207 of this example multiplies the predetermined values Ws(l) by the correction values $b_{2j}(n)$ to obtain the current filter coefficient data $WD_j(n)$. However, LMS operation unit 207 may correct the predetermined values Ws(l) with the correction values $b_{2j}(i)$ and the correction values $b_{\theta j}(i)$ to obtain the filter coefficients $W_j(i)$ and the filter coefficient data $WD_j(i)$. In this case, for example, LMS operation unit 207 multiplies the predetermined values Ws(l) by the correction values $b_{\theta j}(i)$, or performs addition or subtraction. The correction values $b_{2j}(i)$ are determined by the first apparatus information $s_1(i)$ and the second apparatus information $s_2(i)$. The correction values $b_{\theta j}(i)$ are determined by the second apparatus information $s_2(i)$ and the third apparatus information $s_3(i)$, or by the first apparatus information $s_1(i)$ and the third apparatus information $s_3(i)$.

Alternatively, correspondence table 211 of another example may store the correction value $b_{123}(l_1,l_2,l_3)$ for the predetermined value $Ws(l_1,l_2,l_3)$. That is, the correction value $b_{123}(l_1,l_2,l_3)$ for the predetermined value $Ws(l_1,l_2,l_3)$ is stored as the apparatus information data $Sd_{123}(l_1,l_2,l_3)$ corresponding to the first apparatus information data $Sd_1(l_1)$, the second apparatus information data $Sd_2(l_2)$, and the third apparatus information data $Sd_3(l_3)$. In this case, a sheet (third apparatus information data $Sd_3(l_3)$) that serves as a reference for correspondence table 211 is determined, and a reference column (second apparatus information data $Sd_2$ $(l_2)$) of the determined reference sheet is determined. The predetermined value $Ws(l_1,l_2,l_3)$ corresponding to the first apparatus information data $Sd_1(l_1)$ may be stored only for this reference column. The correction value $b_{123}(l_1,l_2,l_3)$ for the predetermined value $Ws(l_1,l_2,l_3)$ in the reference column is set at 1.

Correspondence table 211 of another example may be configured to store the correction value $b_{123}(l_1,l_2,l_3)$ corresponding to the apparatus information data $Sd_{123}(l_1,l_2,l_3)$. In this case, if the second or third apparatus information changes, control block 208 changes the sheet or column to select, and reads the correction value $b_{123}(l_1,l_2,l_3)$ at the position. Control block 208 then multiplies the predetermined value $Ws(l_1,l_2,l_3)$ by the correction value $b_{123}(l_1,l_2,l_3)$ to calculate the current filter coefficients $W_j(n)$ and the filter coefficient data $WD_j(n)$. Such a configuration, which needs to store only the correction value $b_{123}(l_1,l_2,l_3)$ in storage unit 11, can decrease the capacity of the storage area of storage unit 11.

Furthermore, correspondence table 211 of another example may be configured to store the predetermined values Ws(i) corresponding to two pieces of apparatus information $s_\theta(i)$ out of the first apparatus information $s_1(i)$, the second apparatus information $s_2(i)$, and the third apparatus information $s_3(i)$, and to store the correction values $b_{\theta j}(i)$ corresponding to the remaining one piece of apparatus information $s_\theta(i)$. Alternatively, correspondence table 211 may be provided with correspondence table sheets 211*c*, wherein a number of correspondence table sheets 211*c* is a number of combinations for selecting two pieces of apparatus information $s_\theta(i)$ out of θ pieces of apparatus information $s_\theta(i)$.

According to the present exemplary embodiment, although LMS operation unit 207 performs the above-described correction, adjustment unit 209 in cancel signal generation block 205 may perform the correction. Alternatively, it is also possible that control block 208 performs the correction.

Figure 18:
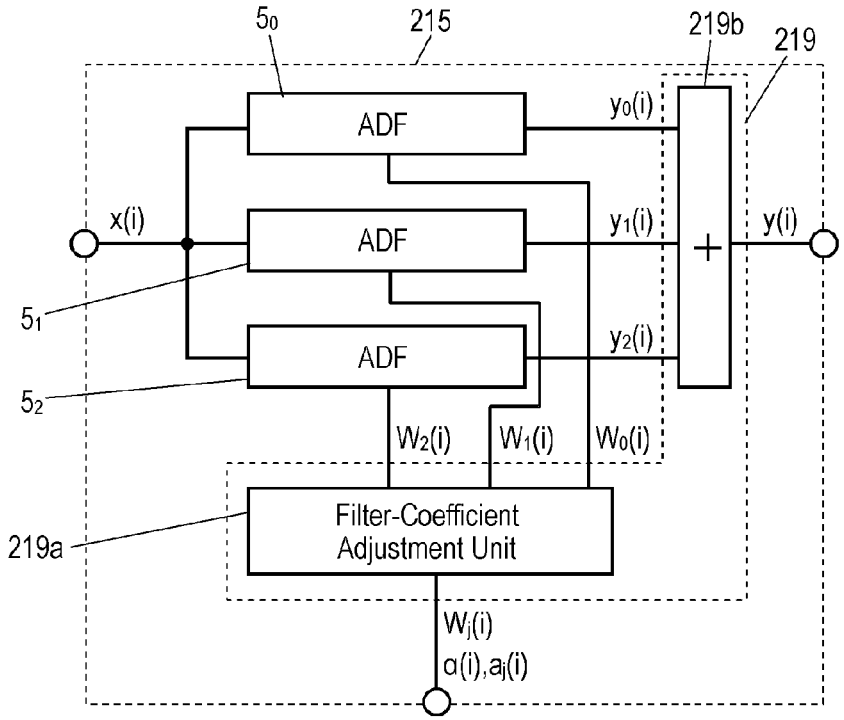
FIG. 18 is a block diagram of an active noise reduction device cancel signal generation block of the second example according to Embodiment 2.

Next, cancel signal generation block 215 of the second example according to Embodiment 2 will be described. FIG. 18 is a block diagram of cancel signal generation block 215 of this example. Cancel signal generation block 215 includes adjustment unit 219 and plural (the number G) of ADFs $\mathbf{5}_g$, (g=0, 1, . . . , G−1). Adjustment unit 219 further includes filter-coefficient adjustment unit 219*a* and summing unit 219*b*. Summing unit 219*b* sums up output signals of ADFs $\mathbf{5}_g$ and outputs the summed up signal to output terminal 42.

Filter-coefficient adjustment unit 219*a* generates the filter coefficients Wg(n) to be used by ADFs $\mathbf{5}_g$ based on the filter coefficients $W_g(n)$. For this purpose, filter-coefficient adjustment unit 219*a* multiplies the received filter coefficients $W_g(n)$ by the contribution degrees $a_g(n)$ and the level adjustment coefficient α(n). First, the following describes a case where the number G of ADFs $\mathbf{5}_g$ is equal to the number J of the filter coefficients $W_j(n)$ calculated by LMS operation unit 207. In this case, filter-coefficient adjustment unit 219*a* generates the filter coefficients Wg(n) as expressed by Formula 24.

$$Wg(n)=\alpha(n)\cdot a_g(n)\cdot W_g(n) \quad \text{(Formula 24)}$$

Although it is assumed that the number of ADFs $\mathbf{5}_g$ of this example is three, which is the number of ADFs $\mathbf{5}_0$ to $\mathbf{5}_2$, the number of ADFs $\mathbf{5}_g$ is not limited to three, and may be two, or more than three. For example, if the number G of ADFs $\mathbf{5}_g$ are used, the filter coefficients (for example, $W_0(i)$, $W_1(i)$)

of two ADFs $5_g$ out of the number G of ADFs $5_g$ are processed by a procedure in the same way as described above. As the filter coefficients Wg(i) of the other ADFs $5_g$, the predetermined values Ws(l) determined by control block 208 are used. In this case, for example, all the contribution degrees $a_j$(i) other than ADF $5_0$ and ADF $5_1$ are 0.

If such a configuration is used, each of ADFs $5_g$ performs a convolution operation, leading to larger amount of operation. Accordingly, if this configuration is used, active noise reduction device 204 is preferably constituted by using a CPU, a DSP, or the like that can perform parallel processing. As a result, the increase in the sampling period T*s* can also be controlled.

Next, the following describes a case where the number G of ADFs $5_g$ is smaller than the number J=$h_g$ of the filter coefficients $W_j$(n) calculated by LMS operation unit 207. In this case, filter-coefficient adjustment unit 219*a* uses the contribution degrees $a_j$(n), the level adjustment coefficient α(n), and the plurality of filter coefficients $W_j$(n) to calculate the filter coefficients Wg(n). Filter-coefficient adjustment unit 219*a* then generates G filter coefficients Wg(n), for example, as expressed by Formula 25. That is, filter-coefficient adjustment unit 219*a* performs addition of the consecutive two or more filter coefficients $W_j$(n) with weighting of the contribution degrees $a_j$(n), and generates the G filter coefficients Wg(n) from the $h_g$ filter coefficients $W_j$(n).

$$W0(n) = \alpha(n)\sum_{j=0}^{h1} a_j(n)\cdot W_j(n) \qquad \text{(Formula 25)}$$

$$W1(n) = \alpha(n)\sum_{j=h1+1}^{h2} a_j(n)\cdot W_j(n)$$

$$\vdots$$

$$Wg(n) = \alpha(n)\sum_{j=h_{g-1}+1}^{h_g} a_j(n)\cdot W_j(n)$$

The following describes an example where cancel signal generation block 215 includes three ADFs $5_0$, $5_1$, and $5_2$, and where control block 208 selects four pieces of apparatus information data Sd(j,l). The following describes an example where a velocity v(n) of an automobile is selected as the apparatus information s(i), and where velocity information data vd(l) is selected as the apparatus information data $Sd_\theta(l_\theta)$.

If the velocity v(n) of an automobile is 17 km/h, the filter coefficient W0(i) of ADF $5_0$ is determined by the velocity information data vd(15) and the contribution degree $a_0$. Meanwhile, the filter coefficient W1(i) of ADF $5_1$ is calculated by performing addition of the velocity information data vd(20) and vd(25) with weighting of the contribution degrees $a_1$ and $a_2$. Furthermore, the filter coefficient W2(i) of ADF $5_2$ is determined by the velocity information data vd(30) and the contribution degree $a_3$.

Although filter-coefficient adjustment unit 219*a* of this example calculates the filter coefficient W1(i) with the two pieces of apparatus information data Sd(j,i), filter-coefficient adjustment unit 219*a* may calculate either filter coefficient Wg(i) with the plurality of pieces of apparatus information data Sd(j,i). Filter-coefficient adjustment unit 219*a* may calculate the filter coefficients Wg(i) with three or more pieces of the apparatus information data Sd (j,i).

Each of ADFs $5_g$ receives the reference signal x(i). As a result, ADFs $5_g$ output the filter output signals $y_g$(i) with the filter coefficients Wg(i), respectively. Summing unit 219*b* then adds (sums up) the filter output signals $y_g$(i) that are output from ADFs $5_g$, and outputs the cancel signal y(i).

The aforementioned configuration makes an adjustment to decrease the level of the cancel signal y(i) if control block 208 determines that the level of the reference signal x(i) is small. Accordingly, similarly to Embodiment 1, even if the level of the reference signal x(i) is small, generation of an abnormal sound can be controlled.

Control block 208 generates the level adjustment coefficient α(i), similarly to Embodiment 1. Control block 208 then supplies the level adjustment coefficient α(i) to filter-coefficient adjustment unit 219*a*. As a result, filter-coefficient adjustment unit 219*a* performs level adjustment of the cancel signal y(i) by using the level adjustment coefficient α(i), and performs correction of the filter coefficient Wg(i) by using the contribution degrees $a_j$(i). However, adjustment unit 219*a* may be divided into an adjustment unit that performs correction on the filter coefficients $W_j$(i) with the contribution degrees $a_j$(i), and into an adjustment unit that performs level adjustment of the cancel signal y(i). In this case, filter-coefficient adjustment unit 219*a* corrects the filter coefficients $W_j$(i) only with the contribution degrees $a_j$(i). Meanwhile, level adjustment of the cancel signal y(i) may be performed by any one of adjustment units 9, 139, 149, 159, 169, and 179 of each example according to Embodiment 1, the adjustment units being provided either between ADFs $5_g$ and summing unit 219*b*, or between summing unit 219*b* and output terminal 42, or provided between reference signal input terminal 41 and ADFs $5_g$.

In place of ADFs $5_g$, either of cancel signal generation blocks 165 or 175 may be used. If cancel signal generation block 165 is used in place of ADFs $5_g$, and if both summing unit 169*c* and summing unit 219*b* perform an addition operation, the outputs of ADFs $5_g$ and an output of correction signal generation unit 169*b* may be supplied directly to summing unit 219*b*. In this case, summing unit 219*b* adds these signals simultaneously. Such a configuration eliminates the need for summing unit 169*c*.

If cancel signal generation block 175 is used in place of ADFs $5_g$, summing unit 219*b* may include summing unit 179*c*.

Figure 19:
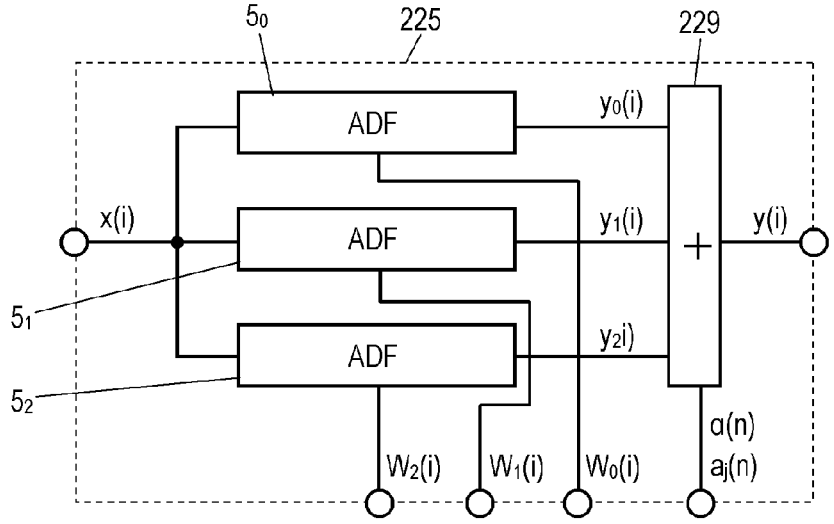
FIG. 19 is a block diagram of the cancel signal generation block of the active noise reduction device of the third example according to Embodiment 2.

Next, cancel signal generation block 225 of the third example according to the present exemplary embodiment will be described. FIG. 19 is a block diagram of cancel signal generation block 225. Cancel signal generation block 225 includes the plurality of ADFs $5_j$ and adjustment unit 229. All ADFs $5_j$ receive the reference signal x(i). In this example, ADFs $5_j$ receive the filter coefficients $W_j$(i) calculated by LMS operation unit 207 without being changed, respectively.

Adjustment unit 229 is provided between ADFs $5_j$ and output terminal 42 illustrated in FIG. 15. Adjustment unit 229 outputs the cancel signal y(i) based on Formula 26. That is, adjustment unit 229 adds (sums up) the outputs of ADFs $5_j$ in accordance with the contribution degrees $a_j$(i) and the level adjustment coefficient α(n), and outputs the cancel signal y(i). Although the number of ADFs $5_j$ of this example is three, the number is not limited to three, and may be two, or four or more.

$$y(n) = \alpha(n)\sum_{j=0}^{2} a_j(n)\cdot y_j(n) \qquad \text{(Formula 26)}$$

Adjustment unit 229 performs level adjustment of the cancel signal y(i) by using the level adjustment coefficient α(i). Adjustment unit 229 also performs an adjustment of contribution of the filter coefficient W(i) to the cancel signal y(i) by using the contribution degrees $a_j(i)$. However, adjustment unit 229 may be divided into an adjustment unit that performs correction on the filter coefficients $W_j(n)$ with the contribution degrees $a_j(i)$, and into an adjustment unit that performs level adjustment of the cancel signal y(n). In this case, adjustment unit 229 corrects the filter coefficients $W_j(i)$ only with the contribution degrees $a_j(i)$. Meanwhile, level adjustment of the cancel signal y(i) may be performed by any one of adjustment units 9, 139, 149, 159, 169, and 179 of each example according to Embodiment 1, the adjustment units being provided either between ADFs $\mathbf{5}_j$ and adjustment unit 229 or between adjustment unit 229 and output terminal 42. Alternatively, any one of adjustment units 9, 139, 149, 159, 169, and 179 of each example according to Embodiment 1 may be provided between reference signal input terminal 41 and ADFs $\mathbf{5}_j$.

In place of ADFs $\mathbf{5}_j$, either of cancel signal generation blocks 165 or 175 may be used. If cancel signal generation block 165 is used in place of ADFs $\mathbf{5}_j$, and if both summing unit 169*c* and summing unit 229*b* perform an addition operation, the outputs of ADFs $\mathbf{5}_j$ *and* the output of correction signal generation unit 169*b* may be supplied directly to summing unit 229*b*. Summing unit 229*b* then adds these signals simultaneously. This configuration eliminates the need for summing unit 169*c*.

If cancel signal generation block 175 is used in place of ADFs $\mathbf{5}_j$, adjustment unit 229 may include summing unit 179*c*.

Next, LMS operation unit 237 of the fourth example of the present exemplary embodiment will be described. LMS operation unit 237 of this example illustrated in FIG. 15 generates the next-step filter coefficients $W_j(n+1)$, as expressed by Formula 27. That is, the next filter coefficients $W_j(n+1)$ are calculated from the prepared filtered reference signal R(n), the current error signal e(n), the step size parameter μ, the filter coefficients $W_j(n)$ calculated last time by LMS operation unit 237, and the correction values $b_j(n)$. In this example, the filter coefficient data $WD_j(i)$ is not used and does not need to be calculated. Therefore, capacity of storage unit 11 may be small.

$$W_j(n+1)=W_j(n)-b_j(n)\cdot\mu\cdot e(n)\cdot R(n)$$

An operation of LMS operation unit 237 will be described. In LMS operation step 606 illustrated in FIG. 4, the filter coefficients $W_j(n+1)$ to be used in next cancel signal generation step 607 is calculated. As a result, the filter coefficients $W_j(n)$ used in current cancel signal generation step 607 are updated into the new filter coefficients $W_j(n+1)$ calculated in LMS operation step 606. For this purpose, only the filter coefficients $W_j(n+1)$ are generated and stored in storage unit 11 in LMS operation step 606. In filter coefficient operation step 606*b*, the next filter coefficients $W_j(n+1)$ are calculated, as expressed by Formula 27. Here, the filter coefficients $W_j(n+1)$ are filter coefficients to be used in next cancel signal generation step 607. The filter coefficients $W_j(n+1)$ are calculated by using the current error signal e(n), the filtered reference signal R(n), and the step size parameter μ. The filtered reference signal R(n) mentioned here is a signal calculated in Chat generation step 504.

Exemplary Embodiment 3

Figure 20:
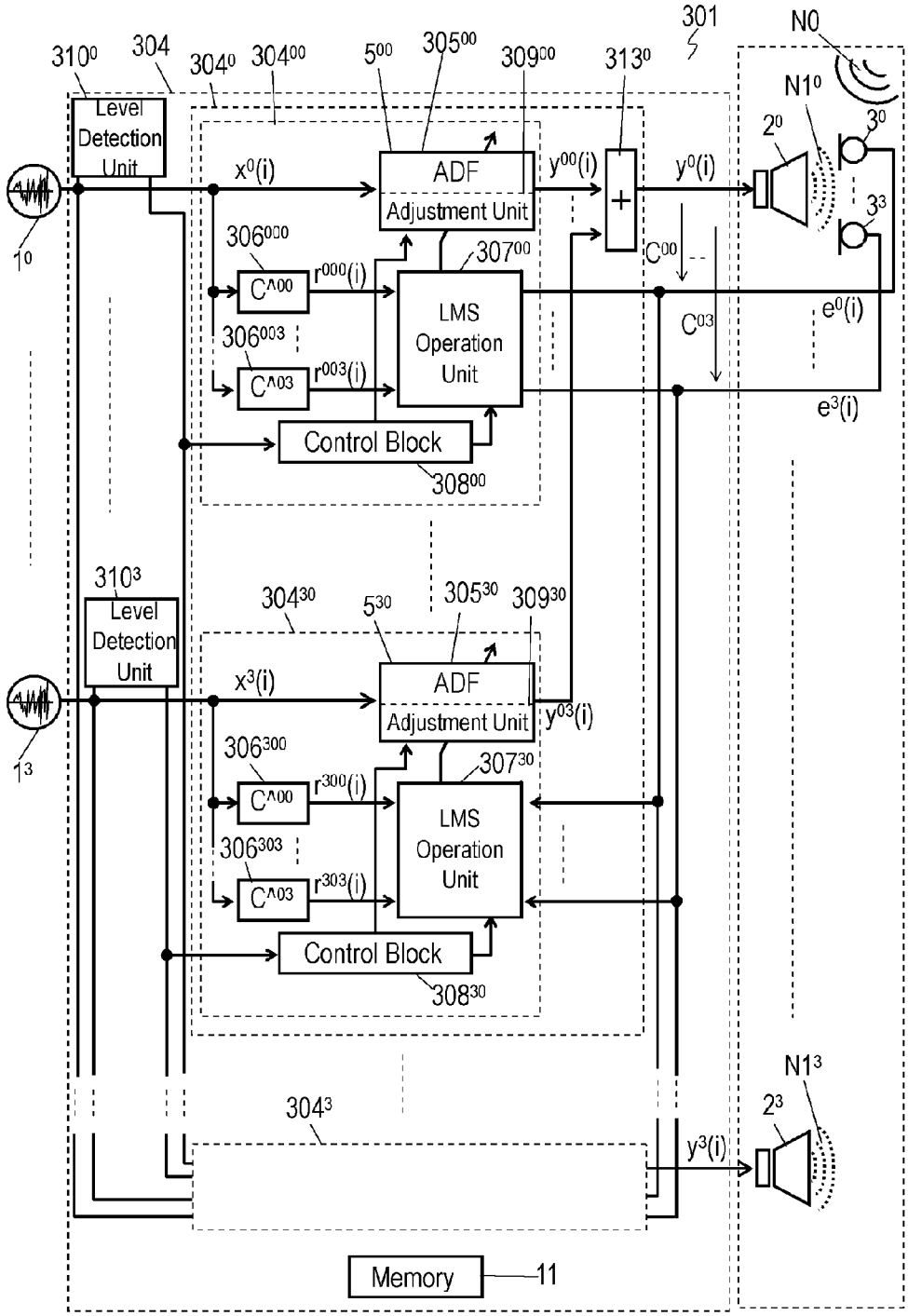
FIG. 20 is a block diagram of an active noise reduction system using an active noise reduction device according to Exemplary Embodiment 3 of the present invention.
Figure 21:
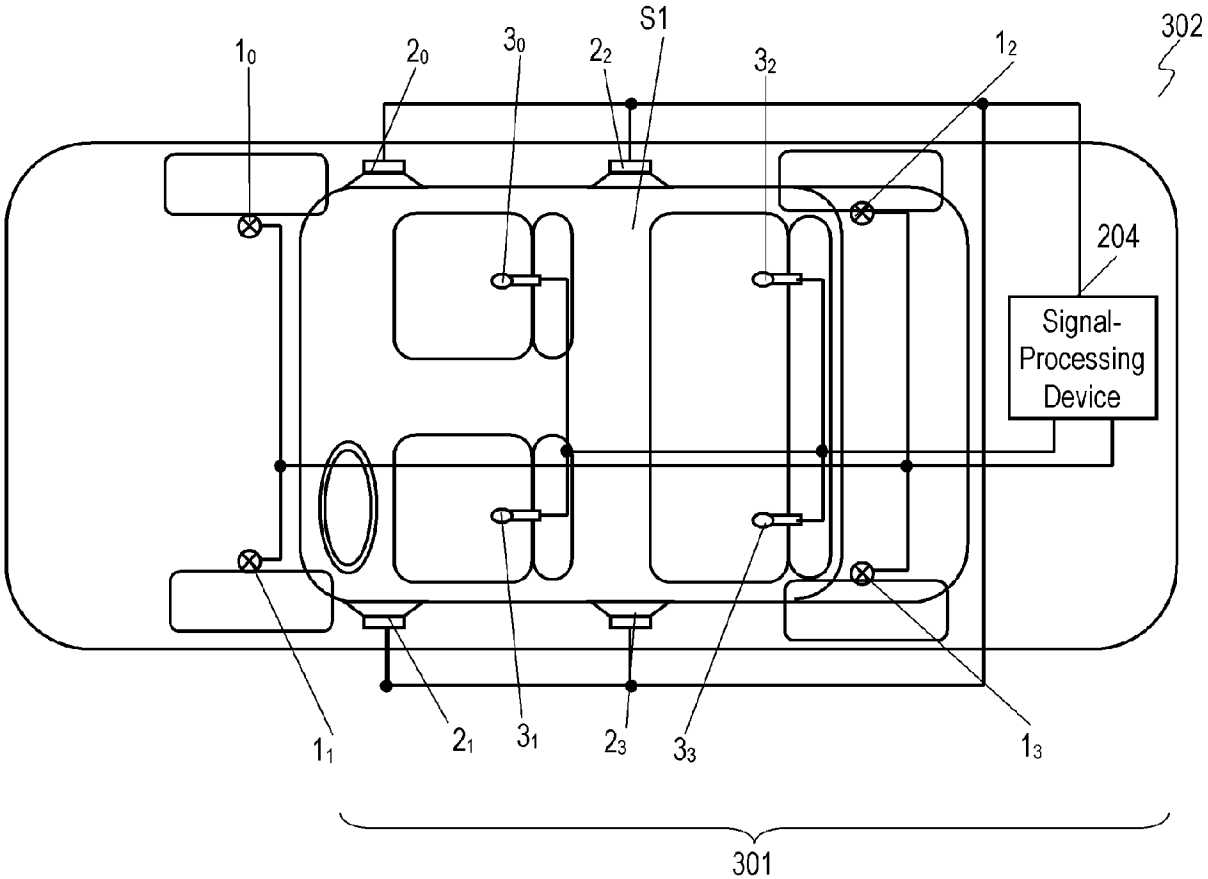
FIG. 21 is a schematic diagram of a mobile unit apparatus using the active noise reduction device according to Embodiment 3.
Figure 22:
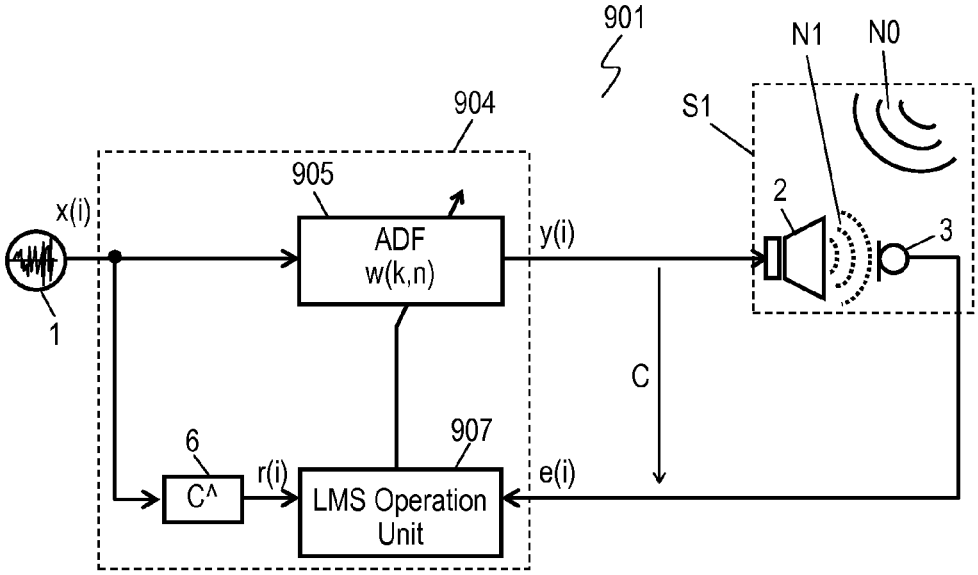
Fig. 22 PRIOR ART
FIG. 22 is a block diagram of a conventional active noise reduction system.

FIG. 20 is a block diagram of multichannel active noise reduction system 301 according to Exemplary Embodiment 3 of the present invention. FIG. 21 is a schematic diagram of apparatus 302 in which multichannel active noise reduction system 301 is mounted. In FIG. 20 and FIG. 21, components identical to components of active noise reduction system 101 and automobile 102 illustrated in FIG. 1 and FIG. 2 are denoted by the same reference numerals.

Active noise reduction system 101 according to Embodiment 1 includes one reference signal source 1, one cancel sound source 2, one error signal source 3, and active noise reduction device 4. In contrast, multichannel active noise reduction system 301 according to the present exemplary embodiment uses multichannel active noise reduction device 304.

Multichannel active noise reduction device 304 uses one or more reference signal sources $\mathbf{1}^{\xi}$, one or more cancel sound sources $\mathbf{2}^{\eta}$, and one or more error signal sources $\mathbf{3}^{\xi}$ to reduce a noise in space S1. Here, ξ represents a number of reference signal sources 1, η represents a number of cancel sound sources, and ξ represents a number of error signal sources. Hereinafter, attachment of such a subscript indicates association with a signal source of each subscript.

The following describes an example of multichannel active noise reduction system 301 that includes four reference signal sources $\mathbf{1}^0$ to $\mathbf{1}^3$, four cancel sound sources $\mathbf{2}^0$ to $\mathbf{2}^3$, and four error signal sources $\mathbf{3}^0$ to $\mathbf{3}^3$.

Multichannel active noise reduction system 301 of this example includes four multichannel active noise reduction devices $\mathbf{304}^0$ to $\mathbf{304}^3$. In addition, each of multichannel active noise reduction devices $\mathbf{304}^{\eta}$ further includes four active noise reduction devices $\mathbf{304}^{0\eta}$ to $\mathbf{304}^{3\eta}$, and signal adder $\mathbf{313}^{\eta}$. Signal adder $\mathbf{313}^{\eta}$ adds output signals from active noise reduction devices $\mathbf{304}^{\xi\eta}$, and outputs each of signals $y^{\eta}(i)$. Multichannel active noise reduction system 301 also includes level detection units $\mathbf{310}^{\xi}$ for detecting signal levels $L_x^{\xi}(i)$ of reference signals $x^{\xi}(i)$ corresponding to reference signal sources $\mathbf{1}^{\xi}$.

Although the numbers of reference signal sources $\mathbf{1}^{\xi}$, cancel sound sources $\mathbf{2}^{\eta}$, and error signal sources $\mathbf{3}^{\xi}$ are four, these numbers are not limited to four. These numbers may differ from one another.

First, an operation of multichannel active noise reduction device $\mathbf{304}^{\eta}$ in which each of cancel sound sources $\mathbf{2}^{\eta}$ emits cancel sound $\mathbf{N1}^{\eta}$ will be described. Multichannel active noise reduction device $\mathbf{304}^1$ includes active noise reduction devices $\mathbf{304}^{\xi\eta}$. Active noise reduction devices $\mathbf{304}^{\xi\eta}$ of this example may use either cancel signal generation block according to Embodiment 1 or 2.

Active noise reduction devices $\mathbf{304}^{0\eta}$ to $\mathbf{304}^{3\eta}$ receive the reference signals $x^0(i)$ to $x^3(i)$ that are output from reference signal sources $\mathbf{1}^0$ to $\mathbf{1}^3$, and output cancel signals $y^{0\eta}(i)$ to $y^{3\eta}(i)$, respectively.

Each of signal adders $\mathbf{313}^{\eta}$ adds these four cancel signals $y^{\xi\eta}(i)$ and outputs cancel signal $y^{\eta}(i)$. Then, the cancel signal $y^{\eta}(i)$ that is output from multichannel active noise reduction device $\mathbf{304}^{\eta}$ is supplied to cancel sound source $\mathbf{2}^{\eta}$. This configuration causes cancel sound source $\mathbf{2}^{\eta}$ to emit cancel sound $\mathbf{N1}^{\eta}$ corresponding to the cancel signal $y^{\eta}(i)$.

Each of active noise reduction devices $\mathbf{304}^{\xi\eta}$ includes cancel signal generation block $\mathbf{305}^{\xi\eta}$, Chat $\mathbf{306}^{\xi\eta\zeta}$, LMS operation unit $\mathbf{307}^{\xi\eta}$, control block $\mathbf{308}^{\xi\eta}$, and level detection unit $\mathbf{310}^{\xi}$.

Cancel signal generation block $\mathbf{305}^{\xi\eta}$ includes at least each of ADFs $\mathbf{5}^{\xi\eta}$ and calculates the current cancel signal $y^{\xi\eta}(i)$. That is, the cancel signal $y^{\xi\eta}(i)$ is calculated by using each of filter coefficients $W^{\xi\eta}(i)$ and the reference signal $x^{\xi}(i)$. Here, LMS operation unit $\mathbf{307}^{\xi\eta}$ calculates the filter coefficient $W^{\xi\eta}(i)$. Moreover, cancel signal generation block $305^{\xi\eta}$ adjusts a level of the cancel signal $y^{\xi\eta}(i)$ in accordance with an output of control block $308^{\xi\eta}$.

Chat $306^{\xi\eta\zeta}$ corrects the reference signal $x^{\xi}(i)$ with simulated acoustic transfer characteristic data $C^{\wedge\eta\zeta}$, and generates each of filtered reference signals $r^{\xi\eta\zeta}(i)$. Chat $306^{\xi\eta\zeta}$ then outputs the generated filtered reference signal $r^{\xi\eta\zeta}(i)$ to LMS operation unit $307^{\xi\eta}$. LMS operation unit $307^{\xi\eta}$ calculates the filter coefficient $W^{\xi\eta}(i)$ to be used by ADF $5^{\xi\eta}$.

Level detection unit $310^{\xi}$ detects the signal level $L_x^{\xi}(i)$ of the reference signal $x^{\xi}(i)$, and outputs the signal level $L_x^{\xi}(i)$ to control block $308^{\xi\eta}$.

Control block $308^{\xi\eta}$ determines the signal level $L_x^{\xi}(i)$ detected by level detection unit $310^{\xi}$. If control block $308^{\xi\eta}$ determines that the signal level $L_x^{\xi}(i)$ is small, active noise reduction device $304^{\xi\eta}$ decreases the level of the cancel signal $y^{\xi\eta}(i)$.

As illustrated in FIG. 1, as the simulated acoustic transfer characteristic data C^according to Embodiment 1, data that simulates an acoustic transfer characteristic of a signal transfer path is used, the signal transfer path being a path after the cancel signal y(i) is output from cancel signal generation block 105 until the error signal e(i) reaches LMS operation unit 7. Meanwhile, the simulated acoustic transfer characteristic data $C^{\wedge\eta\zeta}$ according to the present exemplary embodiment is the acoustic transfer characteristic that simulates the transfer characteristic from cancel signal generation block $305^{\xi\eta}$ to LMS operation unit $307^{\xi\eta}$. The simulated acoustic transfer characteristic data $C^{\wedge\eta\zeta}$ according to the present exemplary embodiment is represented as a vector with Nc rows and one column, composed of Nc pieces of simulated acoustic transfer characteristic data $c^{\wedge\eta\zeta}$, as expressed by Formula 28. Accordingly, in this example, the simulated acoustic transfer characteristic data $c^{\wedge\eta\zeta}$ is composed of 16 pieces of simulated acoustic transfer characteristic data $c^{\wedge\eta\zeta}$. The simulated acoustic transfer characteristic data $C^{\wedge\eta\zeta}$ may have time-variant values.

$$C^{\wedge\eta\zeta}=[c^{\wedge\eta\zeta}(0),c^{\wedge\eta\zeta}(1),\ldots,c^{\wedge\eta\zeta}(N_c-1)]^T \quad \text{(Formula 28)}$$

The reference signal $X^{\xi}(n)$ is represented as a vector with $N_c$ rows and one column, composed of $N_c$ reference signals $x^{\xi}(i)$, as expressed by Formula 29. That is, the reference signal $X^{\xi}(n)$ is composed of the reference signals from reference signal $x^{\xi}(n)$ reference signal $x^{\xi}(n-(N_c-1))$ past by $(N_c-1)$ steps.

$$X^{\xi}(n)=[x^{\xi}(n),x^{\xi}(n-1),\ldots,x^{\xi}(n-(N_c-1))]T \quad \text{(Formula 29)}$$

Chat $306^{\xi\eta\zeta}$ is connected to reference signal source $1^{\xi}$, and receives the reference signal $x^{\xi}(n)$. Chat $306^{\xi\eta\zeta}$ outputs the filtered reference signal $r^{\xi\eta\zeta}(n)$, as expressed by Formula 30.

$$r^{\xi\eta\zeta}(n)=\sum_{k_c=0}^{N_c-1} c^{\wedge\eta\zeta}(k_c)\cdot x^{\xi}(n-k_c)=C^{\wedge\eta\zeta^T}X^{\xi}(n) \quad \text{(Formula 30)}$$

The filtered reference signal $R^{\xi\eta\zeta}(n)$ is represented as a vector with N rows and one column, as expressed by Formula 31. That is, the filtered reference signal $R^{\xi\eta\zeta}(n)$ is composed of N filtered reference signals $r^{\xi\eta\zeta}(n)$ from the current time to the past by (N−1) steps.

$$R^{\xi\eta\zeta}(n)=[r^{\xi\eta\zeta}(n),r^{\xi\eta\zeta}(n-1),\ldots,r^{\xi\eta\zeta}(n-(N-1))]^T \quad \text{(Formula 31)}$$

Each of error signal sources $3^{\zeta}$ outputs error signal $e^{\zeta}(n)$ corresponding to a residual sound acquired in space S1. If cancel signal generation block 305 is constituted by cancel signal generation blocks 105 to 175 according to Embodiment 1, LMS operation unit $307^{\xi\eta}$ generates the filter coefficient $W^{\xi\eta}(n+1)$, as expressed by Formula 32. That is, the filter coefficient $W^{\xi\eta}(n+1)$ is generated by the current error signal $e^{\zeta}(n)$, the filtered reference signal $r^{\xi\eta\zeta}(n)$, and each of step size parameters $\mu^{\xi\eta\zeta}$.

$$W^{\xi\eta}(n+1)=W^{\xi\eta}(n)-\sum_{\zeta=0}^{3}\mu^{\xi\eta\zeta}\cdot e^{\zeta}(n)\cdot R^{\xi\eta\zeta}(n) \quad \text{(Formula 32)}$$

Alternatively, the filter coefficient $W^{\xi\eta}(n+1)$ can also be generated by using each of level adjustment coefficients $\alpha^{\xi}(n)$ that is output from control block $308^{\xi\eta}$, as expressed by Formula 33.

$$W^{\xi\eta}(n+1)=W^{\xi\eta}(n)-\alpha(n)\sum_{\zeta=0}^{3}\mu^{\xi\eta\zeta}\cdot e^{\zeta}(n)\cdot R^{\xi\eta\zeta}(n) \quad \text{(Formula 33)}$$

Such a configuration causes the next filter coefficient $W^{\xi\eta}(n+1)$ to be generated by updating of the current filter coefficient $W^{\xi\eta}(n)$, based on the error signal $e^{\zeta}(n)$, the filtered reference signal $R^{\xi\eta\zeta}(n)$, the step size parameter $\mu^{\xi\eta\zeta}$, and the level adjustment coefficient $\alpha^{\xi}(n)$. Accordingly, adjustment for decreasing the level of the cancel signal $y^{\xi\eta}(n)$ can control rapid change in the value of the filter coefficient $W^{\xi\eta}(n+1)$.

Furthermore, at least one of the error signal $e^{\zeta}(n)$, the filtered reference signal $R^{\xi\eta\zeta}(n)$, the step size parameter $\mu^{\xi\eta\zeta}$, and the level adjustment coefficient $\alpha^{\xi}(n)$ can be set at 0. Such a configuration prevents the filter coefficient $W^{\xi\eta}(n+1)$ from being updated into a large value by mistake, or into a value based on reference signal noises $x_z^{\xi}(i)$.

Level detection unit $310^{\xi}$ receives the reference signal sources $1^{\xi}(n)$ to $x^{\xi}(n)$. Level detection unit $310^{\xi}$ then detects the signal level $L_x^{\xi}(n)$ of the reference signal $x^{\xi}(n)$, and outputs the detected signal level $L_x^{\xi}(n)$ to control block $308^{\xi\eta}$.

Control block $308^{\xi\eta}$ determines whether the received signal level $L_x^{\xi}(n)$ is equal to or less than a predetermined value. If the value of the signal level $L_x^{\xi}(n)$ of the reference signal $x^{\xi}(n)$ is equal to or less than the predetermined value, control block $308^{\xi\eta}$ determines that the level of the reference signal x(n) is small. If determining that the signal level $L_x^{\xi}(n)$ is small, control block $308^{\xi\eta}$ outputs a control signal for adjusting the level of the cancel signal $y^{\xi\eta}(n)$ to cancel signal generation block $305^{\xi\eta}$.

As cancel signal generation block $305^{\xi\eta}$ of this example, cancel signal generation blocks 105 to 175 according to Embodiment 1 can be used. The following cancel signal generation block $305^{\xi\eta}$ will be described by taking an example of using cancel signal generation block 105.

In this case, cancel signal generation block $305^{\xi\eta}$ includes ADF $5^{\xi\eta}$ and adjustment unit $309^{\xi\eta}$. ADF $5^{\xi\eta}$ generates the cancel signal $y^{\xi\eta}(n)$ based on the reference signal $X^{\xi}(n)$, as expressed by Formula 34.

$$y^{\xi\eta}(n)=\sum_{k=0}^{N-1} w^{\xi\eta}(k,n)\cdot x^{\xi}(n-k)=X^{\xi^T}(n)\cdot W^{\xi\eta}(n) \quad \text{(Formula 34)}$$

Adjustment unit $309^{\xi\eta}$ adjusts the cancel signal $y^{\xi\eta}(n)$, as expressed by Formula 35. For this purpose, adjustment unit

309$^{\xi\eta}$ multiplies the cancel signal $y^{\xi\eta}(n)$ by the level adjustment coefficient $\alpha^{\xi}(n)$ that is output from control block 308$^{\xi\eta}$.

$$y^{\xi\eta}(n)=\alpha^{\xi}(n)\cdot y^{\xi\eta}(n) \quad \text{(Formula 35)}$$

If the signal level $L_x^{\xi}(n)$ is equal to or less than the predetermined value, control block 308$^{\xi\eta}$ outputs the control signal for decreasing the cancel signal $y^{\xi\eta}(n)$ to cancel signal generation block 305$^{\xi\eta}$. For example, if the signal level $L_x^{\xi}(n)$ is larger than the predetermined value, control block 308$^{\xi\eta}$ outputs 1 as the value of the level adjustment coefficient $\alpha^{\xi}(n)$. On the other hand, if the signal level $L_x^{\xi}(n)$ is equal to or less than the predetermined value, control block 308$^{\xi\eta}$ adjusts the value of the level adjustment coefficient $\alpha^{\xi}(n)$ in a range of $0\leq\alpha^{\xi}(n)<1$. Although control block 308$^{\xi\eta}$ of the present exemplary embodiment is provided in each active noise reduction device 304$^{\xi\eta}$, it is not necessary to provide control block 308$^{\xi\eta}$ in each active noise reduction device 304$^{\xi\eta}$. Control block 308$^{\xi}$ corresponding to level detection unit 310$^{\xi}$ may be provided.

Signal adder 313$^{\eta}$ generates the cancel signal $y^{\eta}(n)$. The cancel signal $y^{\eta}(n)$ is generated by a total of the cancel signals $y^{\xi\eta}(n)$ obtained by Formula 35, as expressed by Formula 36.

$$y^{\eta}(n)=\sum_{\xi=0}^{3} y^{\xi\eta}(n) \quad \text{(Formula 36)}$$

As described above, multichannel active noise reduction system 301 updates the filter coefficient $W^{\xi\eta}(i)$ of cancel signal generation block 305$^{\xi\eta}$ every sampling period $T_s$, based on Formula 32 and Formula 33. This configuration allows multichannel active noise reduction system 301 to calculate the cancel signal $y^{\eta}(i)$ best suited for canceling noise N0 at a position of error signal source 3$^{\zeta}$. As a result, noise N0 within space S1 can be reduced.

Control block 308$^{\xi\eta}$ according to the present exemplary embodiment determines magnitude of the signal level $L_x^{\xi}(i)$ of each reference signal $x^{\xi}(i)$, and adjusts magnitude of the corresponding cancel signal $y^{\xi\eta}(i)$. However, control block 308$^{\xi\eta}$ may determine a representative value of the reference signal $x^{\xi}(i)$. For example, one or more reference signals $x^{\xi}(i)$ among the plurality of reference signals $x^{\xi}(i)$ may be used as the representative value. The representative value may be obtained by an average of one or more reference signals $x^{\xi}(i)$. If determining that these representative values are small, control block 308$^{\xi\eta}$ may adjust the plurality of cancel signals $y^{\xi\eta}(i)$. In these cases, it is not necessary to adjust all the cancel signals $y^{\xi\eta}(i)$ for each active noise reduction device 304$^{\xi\eta}$. For example, signal adder 313$^{\eta}$ may have a function of adjustment unit 309$^{\xi\eta}$.

Next, the following describes an example in which cancel signal generation block 305$^{\xi\eta}$ is constituted by cancel signal generation block 205 according to Embodiment 2. In this case, LMS operation unit 307$^{\xi\eta}$ generates the filter coefficients $W^{\xi\eta}{}_j(n+1)$ and filter coefficient data $WD^{\xi\eta}{}_j(n+1)$, as expressed by Formula 37. That is, the filter coefficients $W^{\xi\eta}{}_j(n+1)$ and the filter coefficient data $WD^{\xi\eta}{}_j(n+1)$ are generated by the error signal $e^{\zeta}(n)$, the filtered reference signal $R^{\xi\eta\zeta}(n)$, the step size parameter $\mu^{\xi\eta\zeta}$, and the correction values $b^{\xi}{}_j(n)$ at the current n-th step. The correction values $b^{\xi}{}_j(n)$ are correction values determined by control block 308$^{\xi\eta}$.

$$W_j^{\xi\eta}(n+1)=WD_j^{\xi\eta}(n)-\sum_{\zeta=0}^{3}\mu^{\xi\eta\zeta}\cdot e^{\zeta}(n)\cdot R^{\xi\eta\zeta}(n) \quad \text{(Formula 37)}$$

$$WD_j^{\xi\eta}(n+1)=WD_j^{\xi\eta}(n)-b_j^{\xi}(n)\cdot\sum_{\zeta=0}^{3}\mu^{\xi\eta\zeta}\cdot e^{\zeta}(n)\cdot R^{\xi\eta\zeta}(n)$$

Cancel signal generation block 305$^{\xi\eta}$ calculates the filter coefficient $W^{\xi\eta}(n)$ as expressed by Formula 38. That is, the filter coefficient $W^{\xi\eta}(n)$ is calculated by the filter coefficient $W^{\xi\eta}{}_j(n+1)$, contribution degree $a^{\xi\eta}{}_j(n)$, and the level adjustment coefficient $\alpha^{\xi}(n)$. The filter coefficient $W^{\xi\eta}{}_j(n+1)$ is generated by LMS operation unit 307$^{\xi\eta}$. The contribution degree $a^{\xi\eta}{}_j(n)$ and the level adjustment coefficient $\alpha^{\xi}(n)$ are calculated by control block 308$^{\xi\eta}$.

$$W^{\xi\eta}(n)=\alpha(n)\sum_{j=0}^{2}a_j^{\xi}(n)\cdot W_j^{\xi\eta}(n) \quad \text{(Formula 38)}$$

As described above, multichannel active noise reduction system 301 updates the filter coefficient $W_j{}^{\xi\eta}(i)$ of cancel signal generation block 305$^{\xi\eta}$ every sampling period $T_s$, based on Formula 38. This configuration allows multichannel active noise reduction system 301 to calculate the cancel signal $y^{\eta}(i)$ best suited for canceling noise N0 at the position of error signal source 3$^{\zeta}$. As a result, noise N0 within space S1 can be reduced.

INDUSTRIAL APPLICABILITY

An active noise reduction device according to the present invention has an effect of controlling generation of an abnormal sound even if the level of noise N0 decreases, and is useful when used in apparatuses, such as an automobile.

REFERENCE MARKS IN THE DRAWINGS

1 reference signal source
2 cancel sound source
3 error signal source
4 active noise reduction device
5 adaptive filter
6 simulated acoustic transfer characteristic data filter
7 least mean square operation unit
8 control block
9 adjustment unit
10 level detection unit
11 storage unit
41 reference signal input terminal
42 output terminal
43 error signal input terminal
44 apparatus information input terminal
101 active noise reduction system
102 automobile
105 cancel signal generation block
115 cancel signal generation block
120 level detection unit
120*a* high pass filter
120*b* noise level detector
128 control block
135 cancel signal generation block
139 adjustment unit
145 cancel signal generation block

149 adjustment unit
155 cancel signal generation block
159 adjustment unit
159*a* processing selection unit
159*b* low pass filter
165 cancel signal generation block
169 adjustment unit
169*a* high pass filter
169*b* correction signal generation unit
169*c* summing unit
169*d* phase adjustment unit
175 cancel signal generation block
179 adjustment unit
179*c* summing unit
179*d* phase adjustment unit
201 active noise reduction system
202 automobile
204 active noise reduction device
205 cancel signal generation block
207 LMS operation unit
208 control block
209 adjustment unit
211 correspondence table
211*a* first apparatus information data group
211*b* second apparatus information data group
211*c* correspondence table sheet
212 apparatus information source
215 cancel signal generation block
219 adjustment unit
219*a* filter-coefficient adjustment unit
219*b* summing unit
225 cancel signal generation block
229 adjustment unit
301 multichannel active noise reduction system
302 apparatus
304 multichannel active noise reduction device
305 cancel signal generation block
306 simulated acoustic transfer characteristic data filter
307 LMS operation unit
308 control block
309 adjustment unit
310 level detection unit
313 signal adder
N0 noise
N1 cancel sound
S1 space

The invention claimed is:

1. An active noise reduction device comprising:

a reference signal input terminal configured to have a reference signal input thereto, the reference signal having a correlation with a noise;

a cancel signal generation block including at least an adaptive filter, the cancel signal generation block configured to output a cancel signal in accordance with the reference signal;

an output terminal configured to output the cancel signal output from the cancel signal generation block;

an error signal input terminal configured to have an error signal input thereto, the error signal corresponding to a residual sound caused by interference between the noise and a cancel sound generated from a cancel sound source in response to the cancel signal;

a data filter configured to have the reference signal input thereto and to output a filtered reference signal obtained by correcting the reference signal with simulated acoustic transfer characteristic data that simulates an acoustic transfer characteristic of a signal transfer path of the cancel signal;

a least mean square operation unit configured to update a filter coefficient of the cancel signal generation block by using the error signal, the filtered reference signal, and a step size parameter;

a level detection unit configured to have the reference signal input thereto; and a control block configured to have a signal level input thereto, the signal level being detected by the level detection unit to determine the signal level, wherein the signal transfer path is a signal path from the cancel signal generation block to the least mean square operation unit, and wherein the control block decreases a level of the cancel signal when the signal level of the reference signal is equal to or less than a predetermined value.

2. The active noise reduction device according to claim 1, wherein the control block adjusts at least one of the cancel signal output from the cancel signal generation block, the reference signal input into the cancel signal generation block, and the filter coefficient of the adaptive filter.

3. The active noise reduction device according to claim 1, wherein the control block generates a level adjustment coefficient in accordance with the signal level, and adjusts the level of the cancel signal in accordance with the level adjustment coefficient.

4. The active noise reduction device according to claim 3, wherein the control block adjusts the level of the cancel signal by multiplying, by the level adjustment coefficient, at least one of the cancel signal output from the cancel signal generation block, the reference signal input to the cancel signal generation block, and the filter coefficient of the adaptive filter.

5. The active noise reduction device according to claim 4, wherein the control block decreases a value of the level adjustment coefficient when the signal level of the reference signal is equal to or less than the predetermined value.

6. The active noise reduction device according to claim 1, further comprising:

an adjustment unit configured to adjust the level of the cancel signal in accordance with an output of the control block, wherein the control block decreases the level of the cancel signal via the adjustment unit.

7. The active noise reduction device according to claim 6, wherein the control block generates a level adjustment coefficient in accordance with the signal level, and wherein the adjustment unit multiplies, by the level adjustment coefficient, at least one of the cancel signal output from the cancel signal generation block, the reference signal input into the cancel signal generation block, and the filter coefficient of the adaptive filter.

8. The active noise reduction device according to claim 6, wherein the cancel signal generation block includes the adjustment unit.

9. The active noise reduction device according to claim 6, wherein the control block decreases a value of the level adjustment coefficient when the signal level of the reference signal is equal to or less than the predetermined value.

10. The active noise reduction device according to claim 6, wherein the least mean square operation unit includes the adjustment unit or serves as the adjustment unit, and wherein the adjustment unit adjusts the filter coefficient to be output to the cancel signal generation block in accordance with the output of the control block.

11. The active noise reduction device according to claim 6, wherein the adjustment unit includes a switch, wherein the switch is provided at least one of between the cancel signal generation block and the reference signal source, and between the cancel signal generation block and the cancel sound source, and wherein the switch is turned off when it is determined that the signal level of the reference signal is equal to or less than a predetermined value.

12. The active noise reduction device according to claim 6, further comprising a filter that is one of a high pass filter and a band pass filter to which the reference signal is supplied, wherein the adjustment unit is operable to:

invert a phase of a high-frequency component signal output from the filter, and add the cancel signal to a signal generated by convoluting the high-frequency component signal that has the inverted phase with the filter coefficient.

13. The active noise reduction device according to claim 6, further comprising a filter that is one of a high pass filter and a band pass filter to which the reference signal is supplied, wherein the adjustment unit is operable to:

invert a phase of a high-frequency component signal output from the filter; and sum up the reference signal and the high-frequency component signal that has the inverted phase.

14. The active noise reduction device according to claim 1, wherein, when it is determined that a level of the reference signal is equal to or less than the predetermined value, the control block adjusts at least one of the cancel signal, the reference signal, the filter coefficient, and the level adjustment coefficient to zero so as to stop outputting of the cancel signal.

15. An active noise reduction device comprising:

a reference signal input terminal configured to have a reference signal input thereto, the reference signal having a correlation with a noise;

a cancel signal generation block including at least an adaptive filter, the cancel signal generation block configured to output a cancel signal in accordance with the reference signal;

an output terminal configured to output the cancel signal output from the cancel signal generation block;

an error signal input terminal configured to have an error signal input thereto, the error signal corresponding to a residual sound caused by interference between the noise and a cancel sound generated from a cancel sound source in response to the cancel signal;

a data filter configured to have the reference signal input thereto and to output a filtered reference signal obtained by correcting the reference signal with simulated acoustic transfer characteristic data that simulates an acoustic transfer-characteristic of a signal transfer path of the cancel signal;

a least mean square operation unit configured to update a filter coefficient of the cancel signal generation block by using the error signal, the filtered reference signal, and a step size parameter;

a level detection unit configured to have the reference signal input thereto; and a control block configured to have a signal level input thereto, the signal level being detected by the level detection unit to determine the signal level, wherein the signal transfer path is a signal path from the cancel signal generation block to the least mean square operation unit, wherein the reference signal is a signal that contains a reference signal noise, and wherein the control block decreases a level of the cancel signal when the reference signal noise is detected.

16. The active noise reduction device according to claim 15, wherein the level detection unit includes:

a first filter that is one of a high pass filter and a band pass filter to which the reference signal is supplied; and a noise level detector to which a high-frequency component signal output from the first filter input, the noise level detector detecting a level of the reference signal noise.

17. The active noise reduction device according to claim 16, further comprising an adjustment unit provided at upstream of the adaptive filter, wherein the adjustment unit includes a second filter that is a low pass filter having an attenuation band that includes at least a frequency of the high-frequency component signal, and wherein, when the reference signal noise is detected, the adjustment unit supplies the reference signal to the adaptive filter through the second filter.

18. The active noise reduction device according to claim 16, further comprising an adjustment unit provided at downstream of the adaptive filter, wherein the adjustment unit includes a second filter that is a low pass filter having an attenuation band that includes at least a frequency of the high-frequency component signal, and wherein the cancel sound is generated in response to the cancel signal that passes through the second filter when the reference signal noise is detected.

19. The active noise reduction device according to claim 16, further comprising an adjustment unit configured to adjust the level of the cancel signal in accordance with an output of the control block, wherein, when the reference signal noise is detected, the adjustment unit convolutes the filter coefficient with a low pass filter having an attenuation band that includes at least a frequency of the high-frequency component signal, so that the control block decreases the level of the cancel signal via the adjustment unit.

20. The active noise reduction device according to claim 1, wherein the least mean square operation unit updates the filter coefficient of the cancel signal generation block by using the level adjustment coefficient in addition to the error signal, the filtered reference signal, and the step size parameter.

21. The active noise reduction device according to claim 1, wherein the control block generates a level adjustment coefficient based on the signal level, wherein the least mean square operation unit calculates the filter coefficient by multiplying the error signal by at least one of the level adjustment coefficient and the step size parameter, and wherein, when the control block determines that the signal level of the reference signal is equal to or less than a predetermined value, the least mean square operation unit adjusts at least one of the step size parameter and the level adjustment coefficient to zero, and stops updating of the filter coefficient.

22. The active noise reduction device according to claim 1, further comprising an apparatus information input terminal configured to supply apparatus information to the control block, wherein the control block generates plural filter coefficients based on the apparatus information, and contribution degrees of the plural filter coefficients in the cancel signal, and wherein the adaptive filter generates the cancel signal by using the reference signal, the two or more filter coefficients, the level adjustment coefficient, and the contribution degrees.

23. An apparatus comprising:

the active noise reduction device according to claim 1;

a reference signal source connected to the reference signal input terminal; and the cancel sound source connected to the output terminal, wherein the apparatus has a space in which the cancel sound source emits the cancel sound.

24. An active noise reduction method comprising:

inputting a reference signal and an error signal, the reference signal having a correlation with a noise, the error signal corresponding to a residual sound caused by interference between the noise and a cancel sound corresponding to a cancel signal;

outputting the cancel signal in accordance with the reference signal, said outputting the cancel signal comprising at least performing an operation by an adaptive filter;

receiving the reference signal, correcting the reference signal with simulated acoustic transfer characteristic data that simulates an acoustic transfer characteristic of a signal transfer path of the cancel signal, and outputting a filtered reference signal;

updating a filter coefficient of the adaptive filter by using the error signal, the filtered reference signal, and a step size parameter;

detecting a signal level of the reference signal and determining the detected signal level;

generating a control signal for decreasing a level of the cancel signal when it is determined that the signal level of the reference signal is small; and adjusting the level of the cancel signal in accordance with the control signal, wherein said determining the signal level comprises determining that the signal level of the reference signal is small when the signal level of the reference signal is equal to or less than a predetermined value.

25. The active noise reduction method according to claim 24, wherein said adjusting the level of the cancel signal comprises adjusting the level of the cancel signal in accordance with the control signal output in the control step.

26. The active noise reduction method according to claim 25, wherein said adjusting the level of the cancel signal comprises adjusting at least one of the cancel signal, the reference signal, and the filter coefficient of the adaptive filter in accordance with the control signal.

27. The active noise reduction method according to claim 26, wherein said adjusting the cancel signal comprises multiplying at least one of the cancel signal, the reference signal, and the filter coefficient of the adaptive filter by the level adjustment coefficient.

28. The active noise reduction method according to claim 25, wherein said adjusting the cancel signal comprises adjusting at least one of the cancel signal, the reference signal, and the filter coefficient to zero, and stopping output of the cancel signal when the signal level of the reference signal is equal to or less than the predetermined value.

29. The active noise reduction method according to claim 24, wherein the control signal comprises a level adjustment coefficient.

30. The active noise reduction method according to claim 29, wherein said adjusting the cancel signal comprises decreasing a value of the level adjustment coefficient when the signal level of the reference signal is equal to or less than the predetermined value.

31. An active noise reduction method comprising:

inputting a reference signal and an error signal, the reference signal having a correlation with a noise, the error signal corresponding to a residual sound caused by interference between the noise and a cancel sound corresponding to a cancel signal;

outputting the cancel signal in accordance with the reference signal, said outputting the cancel signal comprising at least performing an operation by an adaptive filter;

receiving the reference signal, correcting the reference signal with simulated acoustic transfer characteristic data that simulates an acoustic transfer characteristic of a signal transfer path of the cancel signal, and outputting a filtered reference signal;

updating a filter coefficient of the adaptive filter by using the error signal, the filtered reference signal, and a step size parameter;

detecting a signal level of the reference signal and determining the detected signal level;

generating a control signal for decreasing a level of the cancel signal when it is determined that the signal level of the reference signal is small; and adjusting the level of the cancel signal in accordance with the control signal, wherein the reference signal is a signal that contains a reference signal noise, and wherein said determining the signal level of the reference signal comprises determining that the signal level of the reference signal is small when the reference signal noise is detected.

32. The active noise reduction method according to claim 31, wherein said determining the signal level of the reference signal comprises detecting the reference signal noise based on a high-frequency component signal of a signal obtained by causing the reference signal to pass through one of a high pass filter and a band pass filter.

33. The active noise reduction method according to claim 32, wherein said adjusting the cancel signal further comprises convoluting the filter coefficient with a low pass filter that includes a frequency of the high-frequency component signal in an attenuation band of the low pass filter when it is determined in the control step that the signal level of the reference signal is small.

34. The active noise reduction method according to claim 32, wherein said adjusting the cancel signal comprises inverting a phase of the high-frequency component signal, generating a signal obtained by convoluting the high-frequency component signal having the inverted phase with the filter coefficient, and summing up the cancel signal and the signal obtained by convolution with the filter coefficient.

35. The active noise reduction method according to claim 32, wherein said adjusting the cancel signal comprises inverting a phase of the high-frequency component signal, and summing up the reference signal and the high-frequency component signal having the inverted phase.

36. The active noise reduction method according to claim 32, wherein said adjusting the cancel signal comprises outputting at least one of the cancel signal and the reference signal through a low pass filter that includes a frequency of the high-frequency component signal in an attenuation band of the low pass filter when it is determined in the control step that the signal level of the reference signal is small.

37. The active noise reduction method according to claim 24, wherein said updating the filter coefficient of the adaptive filter comprises updating the filter coefficient by using the error signal, the filtered reference signal, the step size parameter, and the level adjustment coefficient.

38. The active noise reduction method according to claim 24, wherein said updating the filter coefficient of the adaptive filter comprises adjusting at least one of the step size parameter and the level adjustment coefficient to zero and stopping updating of the filter coefficient when it is determined that the signal level of the reference signal is equal to or less than a predetermined value.

39. The active noise reduction method according to claim 24, further comprising:

inputting apparatus information; and generating plural filter coefficients based on the apparatus information, and contribution degrees of the plural filter coefficients in the cancel signal, wherein said outputting the cancel signal comprises generating the cancel signal by using the reference signal, the plural filter coefficients, the level adjustment coefficient, and the contribution degrees.

* * * * *